US008719089B1

(12) United States Patent
Kent

(10) Patent No.: US 8,719,089 B1
(45) Date of Patent: May 6, 2014

(54) METHODS AND SYSTEMS FOR IMPROVING BID EFFICIENCY OF A CONTENT PROVIDER

(71) Applicant: Google Inc., Mountain View, CA (US)

(72) Inventor: James Kent, London (GB)

(73) Assignee: Google Inc., Mountain View, CA (US)

( * ) Notice: Subject to any disclaimer, the term of this patent is extended or adjusted under 35 U.S.C. 154(b) by 0 days.

(21) Appl. No.: 13/917,094

(22) Filed: Jun. 13, 2013

(51) Int. Cl.
*G06Q 30/00* (2012.01)

(52) U.S. Cl.
USPC ..... 705/14.41; 705/14.4

(58) Field of Classification Search
None
See application file for complete search history.

(56) References Cited

U.S. PATENT DOCUMENTS

| | | | | |
|---|---|---|---|---|
| 8,433,750 | B1 * | 4/2013 | Carlson et al. | 709/203 |
| 2003/0191837 | A1 * | 10/2003 | Chen | 709/224 |
| 2004/0088241 | A1 * | 5/2004 | Rebane et al. | 705/37 |
| 2006/0015409 | A1 * | 1/2006 | Kato et al. | 705/26 |
| 2006/0116926 | A1 * | 6/2006 | Chen | 705/14 |
| 2006/0173744 | A1 * | 8/2006 | Kandasamy et al. | 705/14 |
| 2006/0224496 | A1 * | 10/2006 | Sandholm et al. | 705/37 |
| 2007/0027754 | A1 * | 2/2007 | Collins et al. | 705/14 |
| 2007/0027765 | A1 * | 2/2007 | Collins et al. | 705/14 |
| 2007/0027766 | A1 * | 2/2007 | Collins et al. | 705/14 |
| 2007/0027768 | A1 * | 2/2007 | Collins et al. | 705/14 |
| 2007/0027770 | A1 * | 2/2007 | Collins et al. | 705/14 |
| 2007/0027771 | A1 * | 2/2007 | Collins et al. | 705/14 |
| 2007/0033105 | A1 * | 2/2007 | Collins et al. | 705/14 |
| 2007/0124425 | A1 * | 5/2007 | Gross | 709/217 |
| 2008/0015929 | A1 * | 1/2008 | Koeppel et al. | 705/10 |
| 2008/0021769 | A1 * | 1/2008 | Higgins et al. | 705/11 |
| 2008/0052219 | A1 * | 2/2008 | Sandholm et al. | 705/37 |
| 2008/0215418 | A1 * | 9/2008 | Kolve et al. | 705/10 |
| 2008/0228578 | A1 * | 9/2008 | Mashinsky | 705/14 |
| 2008/0243592 | A1 * | 10/2008 | Song et al. | 705/10 |
| 2008/0255915 | A1 * | 10/2008 | Collins et al. | 705/8 |
| 2009/0112609 | A1 * | 4/2009 | Dangaltchev | 705/1 |
| 2009/0119179 | A1 * | 5/2009 | Kolve et al. | 705/14 |
| 2009/0192888 | A1 * | 7/2009 | Barton et al. | 705/14 |
| 2009/0265243 | A1 * | 10/2009 | Karassner et al. | 705/14.54 |
| 2009/0319333 | A1 * | 12/2009 | Dangaltchev | 705/10 |

(Continued)

OTHER PUBLICATIONS

The Big AdWords Update Enhanced Campaigns Puts the Focus on Mobile [Retrieved on Jun. 12, 2013] [From the internet] http://searchengineland.com/the-big-adwords-update-enhanced-campaigns-puts-the-focus-on-mobile-147626.

(Continued)

*Primary Examiner* — Matthew T Sittner
(74) *Attorney, Agent, or Firm* — Foley and Lardner LLP; John D. Lanza

(57) ABSTRACT

Systems and methods for improving a content provider's bid efficiency in an auction are disclosed. A bid efficiency improvement module of a data processing system identifies a keyword on which a third-party content provider has placed a bid to serve at least one third-party content item. The module retrieves third-party content performance data for the identified keyword. The module determines that the third-party content performance data is sufficient to calculate one or more bid multipliers for the identified keyword. The bid multipliers are calculated based on the retrieved third-party content performance data. The bid multipliers are based on one of a geographic region in which the third-party content item is to be served, a time-of-day at which the third-party content item is to be served, or a type-of-device on which the third-party content item is to be served. The calculated bid multipliers are stored in a memory.

22 Claims, 5 Drawing Sheets

(56) References Cited

U.S. PATENT DOCUMENTS

| | | | | |
|---|---|---|---|---|
| 2011/0040636 | A1* | 2/2011 | Simmons et al. | 705/14.71 |
| 2011/0106622 | A1* | 5/2011 | Kuhlman et al. | 705/14.53 |
| 2012/0016737 | A1* | 1/2012 | Song et al. | 705/14.43 |
| 2012/0036051 | A1* | 2/2012 | Sachson | 705/30 |
| 2012/0041816 | A1* | 2/2012 | Buchalter | 705/14.41 |
| 2012/0072278 | A1* | 3/2012 | Kamangar et al. | 705/14.41 |
| 2012/0078707 | A1* | 3/2012 | Ramakrishnan et al. | 705/14.41 |
| 2012/0246020 | A1* | 9/2012 | Kersten et al. | 705/26.3 |
| 2012/0290386 | A1* | 11/2012 | Skinner | 705/14.46 |
| 2012/0303782 | A1* | 11/2012 | Anderson et al. | 709/223 |
| 2013/0013595 | A1* | 1/2013 | Tseng et al. | 707/723 |
| 2013/0054348 | A1* | 2/2013 | Holsman et al. | 705/14.43 |
| 2013/0268348 | A1* | 10/2013 | Zhou et al. | 705/14.41 |
| 2013/0311270 | A1* | 11/2013 | Daftary et al. | 705/14.43 |

OTHER PUBLICATIONS

Using Custom Ad Scheduling—AdWords Help [Retrieved on Jun. 12, 2013] [From the internet] http://supportgoogle.com/adwords/answer/2404244?hl=en.

* cited by examiner

METHODS AND SYSTEMS FOR IMPROVING BID EFFICIENCY OF A CONTENT PROVIDER

BACKGROUND

Pay-per-click (PPC) products are auction-based systems in which third-party content providers place bids on keywords to provide third-party content. Oftentimes, third-party content providers place inappropriate bids that are either too high or too low due to the third-party content provider's inability to analyze data. These bids are often based on guesswork. By placing inappropriate bids, the third-party content provider tends to pay more for providing third-party content for display, thereby increasing costs and reducing profits for the third-party content provider. At present, some third-party content providers manually analyze reports that include third-party content performance data to determine appropriate bid values but the analysis is time consuming and often done too late to be useful if at all, resulting in efficiency loss and thus lower profit.

SUMMARY

At least one aspect is directed to a computer implemented method for improving a third-party content provider's bid efficiency in an auction for providing third-party content. A bid efficiency improvement module of a data processing system identifies a keyword on which a third-party content provider has placed a bid to serve at least one third-party content item. The bid efficiency improvement module retrieves third-party content performance data for the identified keyword. The bid efficiency improvement module then determines that the third-party content performance data is sufficient to calculate one or more bid multipliers for the identified keyword. The one or more bid multipliers are then calculated based on the third-party content performance data for the identified keyword. Each of the bid multipliers can correspond to at least one parameter having a plurality of discrete states. The bid efficiency improvement module then stores the calculated bid multipliers in a memory element of the data processing system. In some implementations, the retrieved third-party content performance data corresponds to the advertising performance data of an advertiser. In some implementations, the retrieved third-party content performance data corresponds to the third-party content performance data of one or more third-party content providers that have previously placed a bid on the identified keyword.

In some implementations, the third-party content performance data includes one or more of a number of clicks, impressions, cost, average ad position, conversions, click through rate, and conversion rate. In some implementations, the third-party content performance data includes a total number of conversions within a given time period and the threshold volume of data includes a predetermined conversion rate corresponding to the given time period.

In some implementations, when determining, for each of the identified keywords, that the third-party content performance data is sufficient to calculate one or more bid multipliers, the bid efficiency improvement module determines that the third-party content performance data exceeds a threshold volume of data for each of the identified keywords.

In some implementations, the data processing system serves a plurality of third-party content items responsive to placing a plurality of weighted bids. New third-party content performance data is retrieved in response to serving the plurality of third-party content items. The weighted bids are determined to improve bid efficiency in response to comparing the new third-party content performance data with the retrieved third-party content performance data retrieved prior to serving the plurality of third-party content items.

In some implementations, a bid placement module of the data processing system places a weighted bid in response to calculating the bid multipliers. In some implementations, the bid placement module of the data processing system determines that the weighted bid lies within an acceptable range.

In some implementations, each of the bid multipliers is based on one of a geographic region in which the third-party content item is to be served, a time of day at which the third-party content item is to be served, or a type of device on which the third-party content item is to be served. In some implementations, to calculate one or more bid multipliers based on a geographic region in which the third-party content item is to be served, the bid efficiency improvement module identifies, from the third-party content performance data, at least one performance metric for a plurality of geographic regions. The bid efficiency improvement module then determines that the performance metric for the third-party content item is sufficient to calculate a bid multiplier for the geographic region in which the third-party content item is to be served. The performance metric of the geographic region in which the third-party content item is to be served is compared with the performance metric for the plurality of geographic regions and a geographic region bid multiplier for the geographic region in which the third-party content item is to be served is determined responsive to the comparison.

In some implementations, to calculate one or more bid multipliers based on a time of day at which the third-party content item is to be served. the bid efficiency improvement module identifies, from the third-party content performance data, at least one performance metric for a plurality of time periods of a day. The bid efficiency improvement module determines that the performance metric for the plurality of time periods of a day is sufficient to calculate a bid multiplier for the time of day at which the third-party content item is to be served. The performance metric of the time of day at which the third-party content item is to be served is compared relative to the performance metric for the plurality of time periods of a day and a time of day bid multiplier for the time of day at which the third-party content item is to be served is determined responsive to the comparison.

In some implementations, to calculate one or more bid multipliers based on a type of device on which the third-party content item is to be served, the bid efficiency improvement module identifies, from the third-party content performance data, at least one performance metric for a plurality of device types. The bid efficiency improvement module determines that the identified performance metric for the third-party content item is sufficient to calculate a bid multiplier for the type of device on which the third-party content item is to be served. The performance metric of the type of device on which the third-party content item is to be served is compared relative to the performance metric for the plurality of device types and a type of device bid multiplier the type of device on which the third-party content item is to be served is determined responsive to the comparison.

At least one aspect is directed to a computer implemented system for improving an third-party content provider's bid efficiency in an auction. The system includes a data processing system having a bid efficiency improvement module. The data processing system further includes a memory storing processor-executable instructions and a processor. The processor is configured to identify a keyword on which a third-party content provider has placed a bid to serve at least one third-party content item. The bid efficiency improvement module can retrieve third-party content performance data for the identified keyword. The bid efficiency improvement module can determine that the third-party content performance data is sufficient to calculate one or more bid multipliers for the identified keyword. The one or more bid multipliers can then be calculated based on the third-party content performance data for the identified keyword. Each of the bid multipliers can correspond to at least one parameter having a plurality of discrete states. The bid efficiency improvement module can store the calculated bid multipliers in a memory element of the data processing system.

In some implementations, the third-party content performance data includes one or more of a number of clicks, impressions, cost, average ad position, conversions, click through rate, and conversion rate. In some implementations, the third-party content performance data includes a total number of conversions within a given time period and the threshold volume of data includes a predetermined conversion rate corresponding to the given time period.

In some implementations, when determining, for each of the identified keywords, that the third-party content performance data is sufficient to calculate one or more bid multipliers, the bid efficiency improvement module can determine that the third-party content performance data exceeds a threshold volume of data for each of the identified keywords.

In some implementations, the data processing system serves a plurality of third-party content items responsive to placing a plurality of weighted bids. New third-party content performance data can be retrieved in response to serving the plurality of ads. The weighted bids can then be determined to improve bid efficiency in response to comparing the new third-party content performance data with the retrieved third-party content performance data retrieved prior to serving the plurality of third-party content items.

In some implementations, a bid placement module of the data processing system is configured to place a weighted bid in response to calculating the bid multipliers. In some implementations, the bid placement module of the data processing system can determine that the weighted bid lies within an acceptable range.

In some implementations, each of the bid multipliers is based on one of a geographic region in which the third-party content item is to be served, a time of day at which the third-party content item is to be served, or a type of device on which the third-party content item is to be served. In some implementations, to calculate one or more bid multipliers based on a geographic region in which the third-party content provider has elected to serve the at least one ad, the bid efficiency improvement module identifies, from the third-party content performance data, at least one performance metric for a plurality of geographic regions. The bid efficiency improvement module then determines that the performance metric for the plurality of geographic regions is sufficient to calculate a bid multiplier for the geographic region. The performance metric of the geographic region is compared with the performance metric for the plurality of geographic regions and a geographic region bid multiplier is determined responsive to the comparison.

In some implementations, to calculate one or more bid multipliers based on a time of day at which the third-party content item is to be served. the bid efficiency improvement module identifies, from the third-party content performance data, at least one performance metric for a plurality of time periods of a day. The bid efficiency improvement module determines that the performance metric for the plurality of time periods of a day is sufficient to calculate a bid multiplier for the time of day at which the third-party content item is to be served. The performance metric of the time of day at which the third-party content item is to be served is compared relative to the performance metric for the plurality of time periods of a day and a time of day bid multiplier is determined responsive to the comparison.

In some implementations, to calculate one or more bid multipliers based on a type of device on which the third-party content item is to be served, the bid efficiency improvement module identifies, from the third-party content performance data, at least one performance metric for a plurality of device types. The bid efficiency improvement module determines that the performance metric for the plurality of device types is sufficient to calculate a bid multiplier for the type of device on which the third-party content item is to be served. The performance metric of the type of device on which the third-party content item is to be served is compared relative to the performance metric for the plurality of device types and a type of device bid multiplier is determined responsive to the comparison.

These and other aspects and implementations are discussed in detail below. The foregoing information and the following detailed description include illustrative examples of various aspects and implementations, and provide an overview or framework for understanding the nature and character of the claimed aspects and implementations. The drawings provide illustration and a further understanding of the various aspects and implementations, and are incorporated in and constitute a part of this specification.

BRIEF DESCRIPTION OF THE DRAWINGS

The accompanying drawings are not intended to be drawn to scale. Like reference numbers and designations in the various drawings indicate like elements. For purposes of clarity, not every component may be labeled in every drawing. In the drawings.

DETAILED DESCRIPTION

Figure 1:
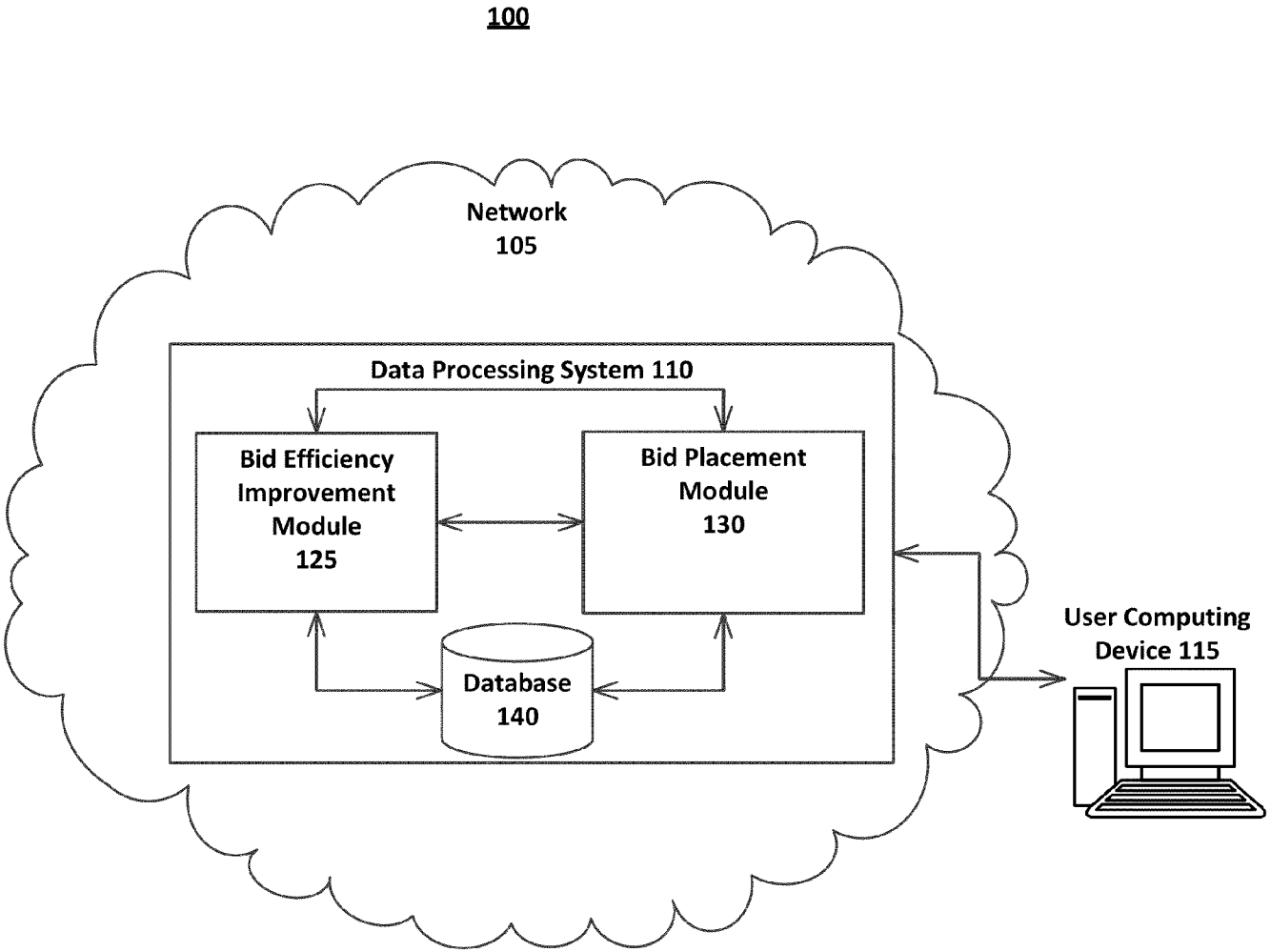
FIG. 1 is a block diagram depicting one implementation of an environment for improving an third-party content provider's bid efficiency in an auction, according to an illustrative implementation.

Following below are more detailed descriptions of various concepts related to, and implementations of, methods, apparatuses, and systems for improving a third-party content provider's bid efficiency in an auction. The various concepts introduced above and discussed in greater detail below may be implemented in any of numerous ways, as the described concepts are not limited to any particular manner of implementation. Examples of specific implementations and applications are provided primarily for illustrative purposes. The systems and methods described herein relate to an algorithmic approach to improving bid efficiency and therefore profit for third-party content providers, reducing the time to optimize multipliers to near-zero and potentially fully automating based on various categorical data efficient bids, increasing profit.

An auction refers to a paid auction in which one or more third-party content providers compete to have one or more third-party content items selected for display in association with web content, which may be referred to herein as first-party content. An auction may be conducted in relation to one or more particular keywords. Accordingly, a third-party content provider may bid on one or more keywords in order to have a third-party content item, or group of third-party content items, selected for presentation in association with that particular keyword or keywords. As used herein, a keyword may include a single word or more than one word in the keyword term.

A third-party content providers that participates in an auction is referred to as a participating third-party content provider. In some implementations, participating third-party content providers submit one or more third-party content items to an auction. Third-party content providers may submit groups of third-party content items. As a participating third-party content provider, a third-party content provider may bid on one or more keywords. By bidding on a keyword, the participating third-party content provider seeks to have its third-party content item selected for presentation in association with items of digital content, which can be first-party content, related to the keyword.

The outcome of an auction may relate to the third-party content providers that participated in the auction, or may relate to the third-party content items that were submitted by third-party content providers that participated in the auction. In some implementations, the outcome of an auction results in a third-party content item either being selected to be displayed along with the digital content related to the keyword or filtered out of the auction. For example, the outcome of an auction may be that a third-party content provider's bid for a keyword in the auction was accepted. A third-party content item that is selected as a result of an auction is referred to as serving a third-party content item. Alternatively, the outcome of an auction may be that a third-party content item is filtered out of the auction, and therefore was not served. As used herein, a third-party content item participating in an auction that is selected to be served as an ad may be referred to as winning an auction, while being filtered out of an auction may be referred to as losing an auction.

Third-party content providers, can in part, win or lose auctions based on the price they bid for a particular auction. Bidding higher in a particular auction can improve a third-party content provider's impression rate, but simultaneously increases the costs of advertising due to the increased bid amount. Third-party content providers can also vary their bid values when participating in auctions. In some implementations, third-party content providers can adjust their bid values by using bid multipliers. Generally speaking, bid multipliers allow third-party content providers to change keyword bids based on one or more parameters. In some implementations, these parameters are associated with a search query or a user requesting the search query. In some implementations, the parameters may be associated with the searcher's location, the day and time, or the type of device the searcher is using, amongst others. The bid multipliers can be applied in real time during the auction for one or more keywords responsive to a search query of a user. Bid multipliers can adjust the value of a base bid set by a third-party content provider upon one or more conditions being met. For instance, a third-party content provider can bid more for an third-party content item that is shown at 3 pm than for an third-party content item that is shown at 3 am. This is possible by setting a bid multiplier, for example, of 1.1 for ads shown between 2 pm and 4 pm, and setting a bid multiplier of 0.8 for ads shown between 2 am and 4 am. Moreover, a third-party content provider can use bid multipliers to bid more for a third-party content item that is shown on a laptop computing device than for a third-party content item shown on a mobile phone. This is possible by setting a bid multiplier, for example, of 1.2 for ads shown on a laptop, while using a bid multiplier of 1 for a third-party content item shown on a mobile phone.

The systems and methods described herein provide an algorithmic approach to improving bid efficiency using a third-party content provider's historical third-party content performance. Bid efficiency can be measured as a ratio of the number of winning bids relative to the total number of bids placed. The systems and methods described herein can improve bid efficiency by being able to adjust the value of the bids being placed in an auction such that bids that are placed are more likely to win. The systems and methods described herein can, based on information associated with the auction, adjust the value of the bid to be placed. In some implementations, the third-party content provider's bid can be adjusted upwards so as to increase the bid being placed. In other implementations, the value of the third-party content provider's bid can be adjusted downwards, while still being sufficiently large to win the auction. These adjustments may be calculated by analyzing the third-party content provider's historical third-party content performance. In some implementations, a data processing system can automatically calculate bid multipliers for one or more discrete states. These discrete states can correspond to geographic regions in which the ad is to be served, times of day at which the ad is to be served or types of devices on which the ad is to be served. The bid multipliers can be calculated based on an analysis of the third-party content provider's past third-party content performance data. Moreover, the data processing system can programmatically place bids in auctions using the calculated bid multipliers and analyze the third-party content provider's performance.

In some implementations, the bid multipliers can correspond to at least one parameter or dimension having a plurality of discrete states. Examples of parameters can include geographic regions, times of day, types of device, browser versions, languages, amongst others. Each parameter can include one or more discrete states. For example, examples of discrete states for a geographic region parameter can include countries, states, provinces, cities, zip codes, addresses, geographic regions having a particular median income level, geographic regions having a particular median education level, amongst others. In another example, examples of discrete states for a time of day parameter can include a particular time of day, such as 8 am, 9 am, 10, am, morning, afternoon, evening, amongst others. Examples of discrete states for a types of device parameter can include laptops, tablets, mobile phones, amongst others.

For situations in which the systems discussed herein collect personal information about a user, or may make use of personal information, the user may be provided with an opportunity to control which programs or features collect such information, the types of information that may be collected (e.g., a user's preferences, a user's current location, a user's type of device, etc.), and/or how third-party content may be selected by the data processing system and presented to the user. Certain data, such as a device identifier, may be anonymized in one or more ways before it is stored or used, so that personally identifiable information is removed when generating parameters (e.g., demographic parameters) used by the data processing system to select third-party content. For example, a device identifier may be anonymized so that no personally identifiable information about its corresponding user can be determined from it. In another example, a user's geographic location may be generalized where location information is obtained (such as to a city, ZIP code, or state level), so that a precise location of the user cannot be determined. Thus, the user may have control over how information is collected about him or her and used by the content selection service. In some implementations, the user can be a user providing a search query or an advertiser providing one or more ads for display. Moreover, certain data can be used by the data processing system as aggregate data. Any personally identifiable information is removed when using such aggregate data. In some implementations, users user may be provided with an opportunity to control whether such data can be used by the data processing system.

In particular, the data processing system is configured to identify one or more keywords a third-party content provider has bid on, retrieve historical third-party content performance data for the identified keywords and determine whether the third-party content performance data is sufficient to calculate, for each of the identified keywords, bid multipliers for one or more parameters that can include one or more discrete states. Examples of such parameters include geographic regions, times of day or types of devices. The data processing system can then use the calculated bid multipliers to adjust the value of a bid for a keyword in an auction for selecting an ad for display. The calculated bid multipliers will be based on one or more parameters, such as the geographic region in which the third-party content item will be served, the time of day at which the third-party content item will be served and the type of device on which the third-party content item will be served. New third-party content performance data from the auctions can be collected and analyzed by comparing the new third-party content performance data with the historical third-party content performance data to test whether the calculated bid multipliers improve the bid efficiency of the third-party content provider.

FIG. 1 is a block diagram depicting one implementation of an environment for improved bid efficiency based on an analysis of historic advertising performance data. In particular, FIG. 1 illustrates a system 100 for improving a third-party content provider's bid efficiency in an auction. In particular, the third-party content provider can be an advertiser participating in one or more advertising auctions. The third-party content provider can place bids on keywords to serve one or more third-party content items, such as advertisements, for display along with first-party content or primary content. The system 100 can identify and utilize an advertiser's historical advertising performance data to calculate bid multipliers that can be used to adjust the value of bids being placed in an auction to improve the bid efficiency of an advertiser.

The system 100 includes at least one data processing system 110. The data processing system 110 can include a processor and a memory, i.e., a processing circuit. The memory stores machine instructions that, when executed by processor, cause processor to perform one or more of the operations described herein. The processor may include a microprocessor, application-specific integrated circuit (ASIC), field-programmable gate array (FPGA), etc., or combinations thereof. The memory may include, but is not limited to, electronic, optical, magnetic, or any other storage or transmission device capable of providing the processor with program instructions. The memory may further include a floppy disk, CD-ROM, DVD, magnetic disk, memory chip, ASIC, FPGA, read-only memory (ROM), random-access memory (RAM), electrically-erasable ROM (EEPROM), erasable-programmable ROM (EPROM), flash memory, optical media, or any other suitable memory from which the processor can read instructions. The instructions may include code from any suitable computer-programming language such as, but not limited to, C, C++, C#, Java, JavaScript, Perl, Python and Visual Basic. The data processing system can include one or more computing devices or servers that can perform various functions. In some implementations, the data processing system can include an advertising auction system configured to host auctions. In some implementations, the data processing system does not include the advertising auction system but is configured to communicate with the advertising auction system via the network 105. The data processing system 110 can include one or more processors or other logic devices such as a computing device having a processor to communicate via a network 105 with at least one user computing device 115. In some implementations, the user computing device 115 and the data processing system 110 can communicate with one another via the network 105.

The network 105 may be any form of computer network that relays information between the user computing device 115, data processing system 110, and one or more content sources, for example, web servers, advertising servers, amongst others. For example, the network 105 may include the Internet and/or other types of data networks, such as a local area network (LAN), a wide area network (WAN), a cellular network, satellite network, or other types of data networks. The network 105 may also include any number of computing devices (e.g., computer, servers, routers, network switches, etc.) that are configured to receive and/or transmit data within network 105. The network 105 may further include any number of hardwired and/or wireless connections. For example, the user computing device 115 may communicate wirelessly (e.g., via WiFi, cellular, radio, etc.) with a transceiver that is hardwired (e.g., via a fiber optic cable, a CATS cable, etc.) to other computing devices in network 105.

The user computing device 115 may be any number of different user electronic devices, for example, a laptop computer, a desktop computer, a tablet computer, a smartphone, a digital video recorder, a set-top box for a television, a video game console, or any other computing device configured to communicate via the network 105. The user computing device can include a processor and a memory, i.e., a processing circuit. The memory stores machine instructions that, when executed by processor, cause processor to perform one or more of the operations described herein. The processor may include a microprocessor, application-specific integrated circuit (ASIC), field-programmable gate array (FPGA), etc., or combinations thereof. The memory may include, but is not limited to, electronic, optical, magnetic, or any other storage or transmission device capable of providing the processor with program instructions. The memory may further include a floppy disk, CD-ROM, DVD, magnetic disk, memory chip, ASIC, FPGA, read-only memory (ROM), random-access memory (RAM), electrically-erasable ROM (EEPROM), erasable-programmable ROM (EPROM), flash memory, optical media, or any other suitable memory from which the processor can read instructions. The instructions may include code from any suitable computer-programming language such as, but not limited to, C, C++, C#, Java, JavaScript, Perl, Python and Visual Basic.

The user computing device 115 may also include one or more user interface devices. In general, a user interface device refers to any electronic device that conveys data to a user by generating sensory information (e.g., a visualization on a display, one or more sounds, etc.) and/or converts received sensory information from a user into electronic signals (e.g., a keyboard, a mouse, a pointing device, a touch screen display, a microphone, etc.). The one or more user interface devices may be internal to a housing of the user computing device 115 (e.g., a built-in display, microphone, etc.) or external to the housing of the user computing device 115 (e.g., a monitor connected to the user computing device 115, a speaker connected to the user computing device 115, etc.), according to various implementations. For example, the user computing device 115 may include an electronic display, which visually displays web pages using webpage data received from one or more content sources and/or from the data processing system 110 via the network 105.

The data processing system 110 can include at least one server. In some implementations, the data processing system 110 includes at least one server of a pay per click (PPC) program, an advertisement auction program, or any other program in which advertisement performance data can be identified. The data processing system 110 includes a bid efficiency improvement module 125 configured to calculate one or more bid multipliers and a bid placement module 130 configured to automatically place adjusted bids on one or more keywords in advertising auctions. Additional details regarding the bid efficiency improvement module 125 and the bid placement module 130 are provided below.

Figure 2A:
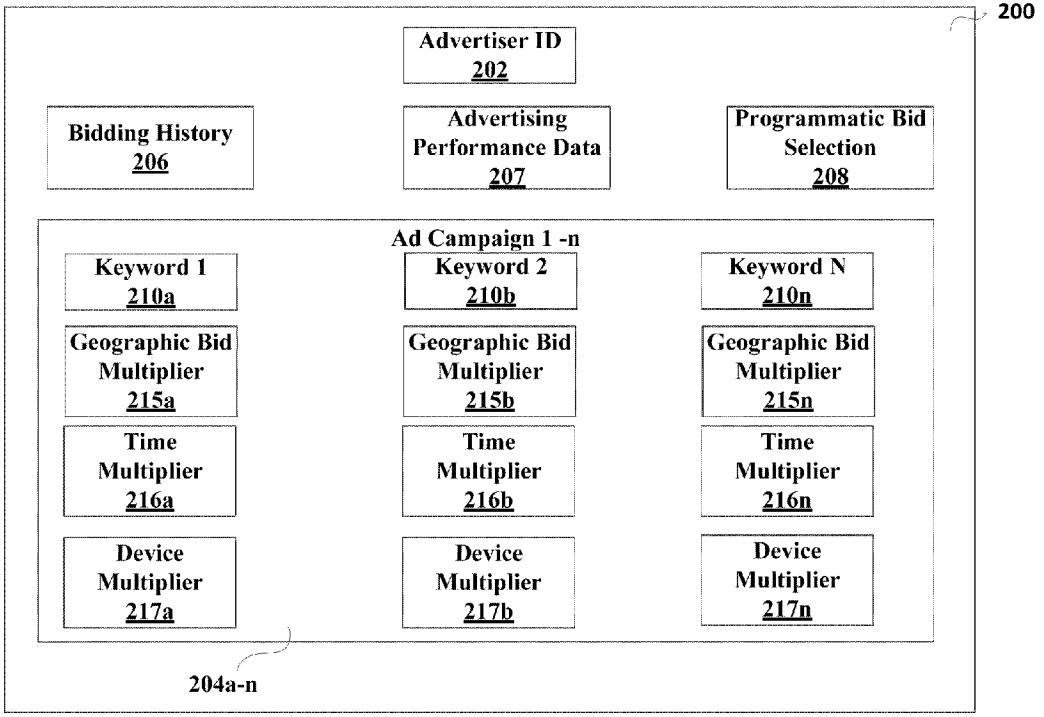
FIG. 2A is a block diagram illustrating an implementation of an third-party content provider's account that includes a plurality of third-party content items.

The data processing system 110 can also include one or more data stores, such as the database 140, which is configured to store information related to one or more advertisers, including an advertiser's advertising account and advertising performance data related to the advertiser's advertising account. For example, referring now briefly to FIG. 2A, a block diagram illustrating aspects of an advertiser's advertising account 200 is shown. As shown in FIG. 2A, an advertiser has an advertising account 200 that is identified by a unique advertiser ID 202. The advertising account 200 can include information relating to one or more advertising campaigns 204*a*-204*n*, each of which can include one or more keywords 210*a*-210*n*. In some implementations, one or more of the advertising campaigns can include one or more ad groups. An ad group can include one or more advertisements, which can be selected for display upon the advertiser winning an auction by placing a bid on a keyword corresponding to the advertisement. The advertising account 200 can include bidding history 206, which includes information about each of the bids placed on the keywords 210 by the advertiser. The advertising account 200 can also include advertising performance data 207, which includes information related to the advertiser's ads and their performance. The advertising account 200 can also include a programmatic bid selection object 208, which is configured to indicate if the advertiser has enabled or disabled programmatic bid selection. If the advertiser has enabled programmatic bid selection, the bid efficiency improvement module 125 is configured to calculate bid multipliers, which can be used by the bid placement module 130 of the data processing system 110 to automatically place bids based on the calculated bid multipliers.

The advertising account 200 can also include one or more bid multipliers calculated by the bid efficiency improvement module 125. The bid multipliers can be specific to a particular keyword. In some implementations, the bid multipliers can be specific to a group of keywords. In some implementations, one or more of the keywords can have one or more geographic region bid multipliers 215, a time of day bid multiplier 216 or a type of device bid multiplier 217. As will be described, the bid multipliers can be specific to particular geographic locations, times of day, or device types, amongst others. Other types of bid multipliers may also be calculated for other parameters, for example, weather conditions where the ad is being served, the content with which the ad is being served, if the ad is being served in response to a search query or along with content to be displayed on a webpage, or other parameters that can be defined by discrete states. In some implementations, examples of other parameters can include languages, browser versions, amongst others.

The database 140 can also include other information, for example, information related to advertisement auctions. In some implementations, the database 140 can store a log of advertising auctions that have taken place. The log can be created from the results of advertiser auctions that have been compiled. The log can be stored in the database 140, such that data from the log can be accessed by the bid efficiency improvement module 125 for data retrieval. The log may also be updated with the results of additional advertiser auctions. In some implementations, the log is updated periodically or continuously with data from additional auctions. As used herein, data refers to the results of advertiser auctions stored in the log. Such data may include items of information regarding one or more advertiser auctions.

Figure 2B:
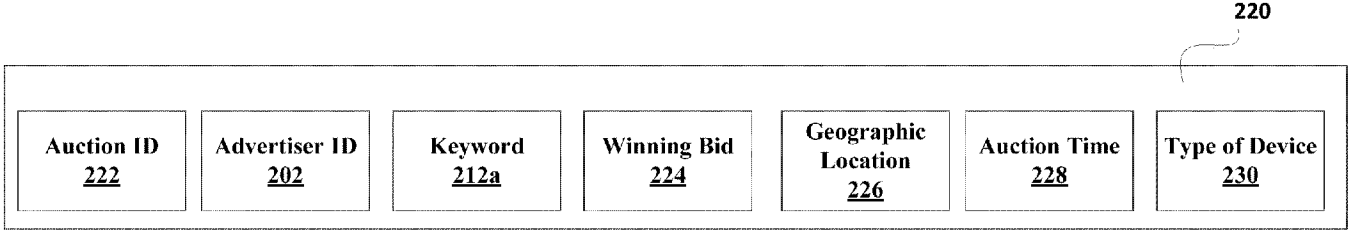
FIG. 2B is a block diagram illustrating an implementation in which parameters of an entry are stored in an auction log.

Referring now briefly to FIG. 2B, a portion of an entry 220 from the log of advertising auctions is shown. In some implementations, data relating to an advertiser auction may include the identity of the advertiser auction, for example, an auction ID 222, one or more advertiser identifiers 202 identifying the one or more advertisers that won the auction, the keyword or keywords 212 associated with the auction ID, and one or more winning bid prices 224. The entry 220 can also include one or more parameters related to the ads being served, including a geographic region in which the ad was served, the time of day at which it was served and the type of device on which the ad was served. In some implementations, the parameters can include information that allows the data processing system to calculate one or more bid multipliers for other types of discrete states. In some implementations, the data processing system can be configured to identify discrete states by accessing other databases to identify trends, for example, weather report information, news-related information, amongst others. In addition, the log can include the ads that were submitted by the advertisers participating in the auction, the keywords that the advertisers were bidding on in the auction, amongst others. For situations in which the systems discussed herein collect personal information about users, including advertisers, or may make use of personal information or information related to the advertiser's account, the user may be provided with an opportunity to control which programs or features collect such information, the types of information that may be collected (e.g., an advertiser's advertising performance data, an advertiser's keywords, an advertiser's bidding history, an advertiser's bidding amounts, an advertiser's bid multipliers, etc.), and/or how the data processing system can use such information.

Referring back now to FIG. 1, the bid efficiency improvement module 125 of the data processing system 110 is designed, constructed or configured to calculate bid multipliers based in part on the advertising performance data of the advertiser. The bid efficiency improvement module 125 can be software, hardware, or a combination of software and hardware. In some implementations, the bid efficiency improvement module 125 can include computer-executable instructions that, when executed by a computing device, causes the computer to perform the functionality described herein.

The bid efficiency improvement module 125 can be configured to identify if an advertiser has opted to participate in programmatic bid selection. By doing so, the advertiser allows the data processing system 110 to analyze the advertiser's advertising performance data and calculate bid multipliers. In some implementations, the bid efficiency improvement module 125 can be configured to determine if an advertiser has selected a programmatic bid selection object. In some implementations, the data processing system 110 can be configured to present, for display, on a user computing device 115 a user interface through which an advertiser can select the programmatic bid selection object. In some implementations, the advertiser's selection of the programmatic bid selection object can be stored in a database that maintains information about the advertiser. For example, the advertiser's selection of the programmatic bid selection object can be stored in a database that contains an advertiser's advertising account. In some implementations, the advertiser's selection of the programmatic bid selection object can be for a particular keyword, a plurality of keywords or all of the keywords on which the advertiser places bids. In some implementations, the bid efficiency improvement module 125 can be configured to perform a lookup of the database to determine if the advertiser has selected to participate in programmatic bid selection as well as determine the keywords for which the advertiser has selected to participate in programmatic bid selection.

The bidding efficiency improvement module 125 can be configured to calculate one or more bid multipliers in response to identifying that an advertiser has elected to participate in programmatic bid selection. In some implementations, a bid multiplier is keyword specific. In some implementations, a bid multiplier is specific to a discrete state. As used herein, a discrete state is a state for which advertising performance data associated with a keyword can be retrieved. An example of a discrete state can be a geographic region, a time of day or a type of device.

Although the present disclosure focuses on discrete states that correspond to parameters, such as geographic regions, times of day and types of devices, the systems and methods can also calculate bid multipliers for other types of parameters that can include discrete states. Examples of such discrete states can be weather conditions, television shows being broadcast, recent news events related to a particular event, amongst others. For example, the winning bid values of the keyword "Kentucky Derby" increases in the month of April and May due to the annual sporting event. As such, the discrete state can be based on months, instead of times of day. Similarly, winning bid values of the keyword "Rain boots" increases during the hurricane season. As such, the discrete states can be seasons. In some other implementations, the discrete states can also be current weather conditions, as the winning bid values for the keyword "Rain boots" increases when the weather at the geographic region in which the ad is being served is rainy.

In some implementations, the bid efficiency improvement module 125 can be configured to calculate bid multipliers for one or more discrete states for one or more keywords using advertising performance data. The bid efficiency improvement module 125 can be configured to identify a keyword that the advertiser has opted in for programmatic bid selection.

In some implementations, the bid efficiency improvement module 125 can retrieve the advertising performance data for a particular advertiser by requesting data related to one or more advertising performance metrics from a database storing such information. In some implementations, the request can specify a time period over which the advertising performance metrics will be evaluated for calculating the bid multipliers. The time period can vary from one hour, one day, one week, one month, one year or multiple years. In some implementations, the time period can correspond to a length of time which is sufficient to be able to identify trends in the winning bid values in auctions related to the particular keyword. As such, keywords that are more common can generally correspond to shorter time periods, while keywords that are less common can correspond to longer time periods.

The bid efficiency improvement module 125 can be configured to retrieve advertising performance data associated with the identified keyword. The advertising performance data includes all data associated with the advertiser's performance in one or more auctions that have taken place for the particular keyword. Examples of the advertiser's performance data can include the advertiser's bid prices, the average bidding price, impression volume, click volume, costs, impression rate, click through rate, conversion rate, cost per click, cost per action, average position rank, position rank amongst others. In addition, the bid efficiency improvement module 125 can retrieve information associated with each auction in which the advertiser places a bid, including but not limited to information associated with the advertisements being served and the user to whom the ad is being served. Examples of some information include a time of the auction, which relates to the time at which the ad would be served, the location of the device on which the ad would be served, the type of device on which the ad would be served, the winning bid, the number of bids, the identity of the winning advertisers, any actions taken on the advertisement, amongst others. This information can be accessible by the bid efficiency improvement module 125 from one or more databases that store auction related data, for example, the auction entry shown in FIG. 2B.

In addition, the bid efficiency improvement module 125 can retrieve data from one or more of the advertisers bidding on the auction. For situations in which the systems discussed herein collect information about advertisers, or may make use of personal information or information related to the advertisers, the advertiser may be provided with an opportunity to control which programs or features collect such information, the types of information that may be collected (e.g., an advertiser's advertising performance data, an advertiser's keywords, an advertiser's bidding history, an advertiser's bidding amounts, an advertiser's bid multipliers, etc.), and/or how the data processing system can use such information. In some implementations, the advertisers may elect not to share information with the data processing system 110. In some implementations, the advertisers can share information with the data processing system so as to improve their own advertising performance. In some such implementations, the advertiser may elect to allow the data processing system to use that information to calculate bid multipliers for the advertiser sharing their information as well as for other advertisers. In some implementations, the bid efficiency improvement module 125 can be configured to retrieve advertising performance data of multiple advertisers associated with the identified keyword. In some implementations, the retrieved advertising performance data corresponds to the advertising performance data of one or more advertisers that have previously placed a bid on the identified keyword. In some such implementations, the advertisers may elect to share their advertising performance data with the bid efficiency improvement module 125. In some implementations, advertisers may select an option to share their advertising performance data. The bid efficiency improvement module can be configured to retrieve advertising performance data of multiple advertisers from one or more advertising auction logs. In some implementations, the bid efficiency improvement module 125 can be configured to retrieve advertising performance data of multiple advertisers from one or more databases that store the advertising performance data of each advertiser.

In some implementations, this information can be stored by an advertising server, which runs the auction process. In some implementations, the bid efficiency improvement module 125 can be configured to make a call to one or more databases to retrieve information. In some implementations, the bid efficiency improvement module 125 can periodically retrieve the information. For example, the bid efficiency improvement module 125 can retrieve the information on a daily basis, a weekly basis, or shorter or longer depending on the amount of data that is generated for the particular keyword. In some implementations, the bid efficiency improvement module 125 can be configured to calculate bid multipliers periodically, for example, once a week. In some implementations, the bid efficiency improve module 125 can retrieve the advertising performance data and other information prior to calculating the bid multipliers.

In some implementations, the bid efficiency improvement module can be configured to execute a script for retrieving the advertising performance data metrics that will be used to determine if there is sufficient volume of data to calculate the bid multipliers. For example, the bid efficiency improvement module can be configured to execute a script to retrieve the advertising performance data metrics that will be used in determining if there is sufficient data to calculate the time of day bid multipliers. Below is a sample function that the bid efficiency improvement module can execute to retrieve the advertising performance data metrics for each hour over a given time period. The sample function is configured to obtain advertising performance data metrics for a time of day bid multiplier.

function getMetricsForAdvertiserByHour (advertiser ID, dateRange).

Using this function, the bid efficiency improvement module 125 can be configured to retrieve the advertising performance data metrics for each hour over a given date range or time period. The result of this function can return an array having advertising performance metrics including click volume, impression volume, click through rate, cost per click cost, conversion volume, cost per conversion, conversion rate, total conversion value and average revenue per conversion corresponding to each hour within the period of time defined by the date range. The advertising performance metrics can correspond to a particular keyword. From this function, the bid efficiency improvement module 125 can also be configured to retrieve an array having advertising performance metrics corresponding to the entire date range, as well as advertising performance metrics corresponding to a 24 hour period.

Similarly, separate functions for retrieving advertising performance data metrics for a variety of discrete states, such as geographic regions, types of devices, amongst others, can be executed by the data processing system. An example generic function for retrieving such advertising performance data is:

function getMetricsForAdvertiserByDiscreteState (advertiser ID, dateRange).

The bid efficiency improvement module 125 is further designed, constructed or configured to determine that the retrieved advertising performance data is sufficient to calculate one or more bid multipliers for a particular keyword. In some implementations, the bid efficiency improvement module 125 is configured to determine, based on the advertising performance data retrieved for a particular keyword, if there is sufficient volume of data to calculate one or more bid multipliers for the particular keyword. In some implementations, the bid efficiency improvement module 125 can be configured to determine if the retrieved advertising performance data is sufficient to calculate a bid multiplier for one or more discrete states.

In some implementations, the bid efficiency improvement module 125 can be configured to determine if a volume of data corresponding to a particular advertising performance metric exceeds a predetermined threshold volume. In some implementations, the data for a particular performance metric that is retrieved corresponds to a particular period of time and the predetermined threshold volume can be based on the same period of time. The period of time can be any reasonable length of time, for example, an hour, a day, a week, a month, amongst others. In some implementations, the length of time can also be based on the keyword and the volume of data associated with the keyword. If the bid efficiency improvement module 125 determines that the volume of data for the performance metric does not exceed a predetermined volume threshold, the bid efficiency improvement module 125 can be configured to not rely on this performance metric for the purposes of calculating bid multipliers. In some implementations, the bid efficiency improvement module 125 can be configured to determine, for data corresponding to other performance metrics, if the volume of data corresponding to a given performance metric of the other performance metrics exceeds a corresponding predetermined threshold volume over a particular length of time. Examples of the other performance metrics can include one or more of the impression volume, click volume, costs, impression rate, click through rate, conversion volume, conversion per click, conversion per action, conversion rate, cost per click, cost per action, amongst others.

An example function for determining, for each of a plurality of discrete states, a volume of data that exceeds a predetermined volume threshold can include function testMetricsForDataVolumeThresholds (advertiserMetrics).

This function can be executed by the bid efficiency improvement module 125 for each of the advertiser performance metrics for which data can be collected. The function can test if the volume of data for a particular metric exceeds a predetermined volume threshold. The function can identify the metrics that exceed the predetermined volume data. The function can include determining if the total data volume of a particular advertiser performance metric exceeds a threshold data volume. If the total data volume does not exceed the threshold data volume, the function determines that there is insufficient volume of data for that particular metric to calculate one or more bid multipliers. However, if the total volume of data retrieved exceeds the threshold data volume, the function can further determine if the advertiser performance metric for a particular discrete state exceeds the threshold data volume for that particular discrete state. For example, the function is configured to determine if the data corresponding to a advertiser performance metric for a particular hour exceeds the threshold data volume for that particular hour. If the advertiser metric for the particular hour does not exceed the threshold data volume, the bid efficiency improvement module 125 does not consider the data corresponding to the particular hour to be statistically sufficient to calculate a bid multiplier for that particular hour. The bid efficiency improvement module 125 may, however, consider data corresponding to those hours that exceed the threshold data volume for calculating one or more bid multipliers.

As just described, the bid efficiency improvement module 125 can be designed, constructed or configured to determine, for each of a plurality of discrete states, if the volume of data retrieved for a particular advertising performance data metric exceeds a predetermined volume threshold corresponding to each of the discrete states. The data corresponds to those performance metrics for which the bid efficiency improvement module 125 determined that the overall volume of data retrieved for a particular advertising performance data exceeded the predetermined overall volume threshold. The discrete states can be predefined. The discrete states for time of day bid multipliers can correspond to hour long time periods, such that there are 24 discrete states each day. The discrete states for geographic region bid multipliers can be cities, states, zip codes, amongst others. The discrete states for type of device bid multipliers can be desktops/laptops, tablets, and mobile phones, amongst others. In some implementations, the bid efficiency improvement module 125 can identify the discrete states for which bid multipliers can be calculated responsive to determining that the data volume corresponding to the particular discrete state exceeds a corresponding predetermined volume threshold. In some implementations, the bid efficiency improvement module 125 can also identify the advertising performance metrics to be used in calculating bid multipliers corresponding to the identified discrete states for which bid multipliers can be calculated.

In some implementations, the bid efficiency improvement module 125 can determine, based on the performance metrics on an hourly basis, one or more hours within a day that have sufficient volume of data for which a bid multiplier can be applied. To determine this, the bid efficiency improvement module 125 can determine if the volume of data retrieved for one or more of the performance metrics that corresponds exceeds a minimum volume threshold. The minimum volume threshold can be defined by the bid efficiency improvement module 125. In some implementations, the bid efficiency improvement module 125 runs a first test comparing the total number of conversions to a predefined daily conversion threshold. If the total number of conversions for a given day or 24 hour period does not exceed the predefined minimum volume threshold for daily conversions, the bid efficiency improvement module 125 determines that there is insufficient volume of data to accurately calculate the bid multipliers for time of day based on conversions. The bid efficiency improvement module can perform a similar test for other performance data metrics, such as click volume, impression volume, click through rates, amongst others.

However, if the total number of conversions for a given day exceeds the predefined minimum volume threshold for daily conversions, the bid efficiency improvement module 125 can be configured to determine, on an hour-by-hour basis, if the conversions for a given hour exceed a hourly conversion threshold. If the conversions for a given hour do not exceed a hourly conversion threshold, the bid efficiency improvement module determines that there is insufficient volume of data to accurately calculate the bid multiplier for that particular hour. However, if the conversions for a given hour exceed a hourly conversion threshold, the bid efficiency improvement module 125 determines that there is sufficient volume of data to accurately calculate the bid multiplier for that particular hour.

Similar tests can be performed for the various geographic regions in which the ads can be served and for the types of devices on which the ads can be served. For example, with respect to geographic regions, the bid efficiency improvement module 125 can identify a plurality of different geographic regions, for example, if the advertiser has limited the ads to be displayed to users within the U.S., the geographic regions can be each of the fifty states, or based on cities, or other geographical limitations. The bid efficiency improvement module 125 can identify, from the retrieved advertisement performance data, one or more performance metrics on the basis of geographic regions. The geographic regions can be based on the geographic regions to which ads were previously served. This can be determined from the database storing a log of all the advertiser's ads corresponding to the identified keyword that were served within the time period for which the advertising performance data was retrieved.

With respect to types of devices, similar tests can be performed to determine if there is sufficient volume of data to calculate bid multipliers based on the various types of devices. As ads are served to users, the type of device on which the ads are served is recorded along with the date and time of day, the geographic location, amongst others. The ads can be recorded in a log that is stored in a database accessible by the bid efficiency improvement module 125.

The bid efficiency improvement module 125 can be designed, constructed or configured to determine if the data corresponding to a performance metric indicates any statistically significant trends. The bid efficiency improvement module 125 can be configured to identify trends using one or more statistical tests. Examples of some statistical tests that can be used include but are not limited to Kendall test, correlation, Hidden Markov model, Pearson product-moment correlation coefficient, Spearman's rank correlation coefficient, amongst other tests. In some implementations, the bid efficiency improvement module 125 can be configured to disregard the advertiser metrics for any discrete state in which the volume of data of the advertiser metrics corresponding to the discrete state does not exceed the predetermined volume threshold when attempting to identify statistically significant trends.

The bid efficiency improvement module 125 can be configured to analyze the data of advertiser metrics that exceed the predetermined volume thresholds to determine if one or more trends can be identified. For example, the bid efficiency improvement module 125 can be configured to determine an average cost per acquisition for Boston, Mass. The bid efficiency improvement module 125 can be configured to determine metrics for each of the discrete states, such that the bid efficiency improvement module 125 can also determine the average cost per acquisition for Austin, Tex., Atlanta, Ga. and San Francisco, Calif.

As an example, the cost per acquisition in Boston, Mass. can be $20 per customer, while the national average is $15 per customer. That means the return that the advertiser gets by advertising in Boston, Mass. is 0.75 times what he would get relative to the national average. The bid efficiency improvement module 125 can be configured to compute a bid multiplier for Boston, Mass. using the cost per acquisition metric to be equal to 0.75. Conversely, the cost per acquisition in Atlanta, Ga. is $7.50 per customer. That means the return that the advertiser gets by advertising in Atlanta, Ga. is 2 times what he would get relative to the national average. As such, the bid efficiency improvement module 125 can compute the bid multiplier for Atlanta, Ga. using the cost per acquisition metric to be equal to 2.

Figure 2C:
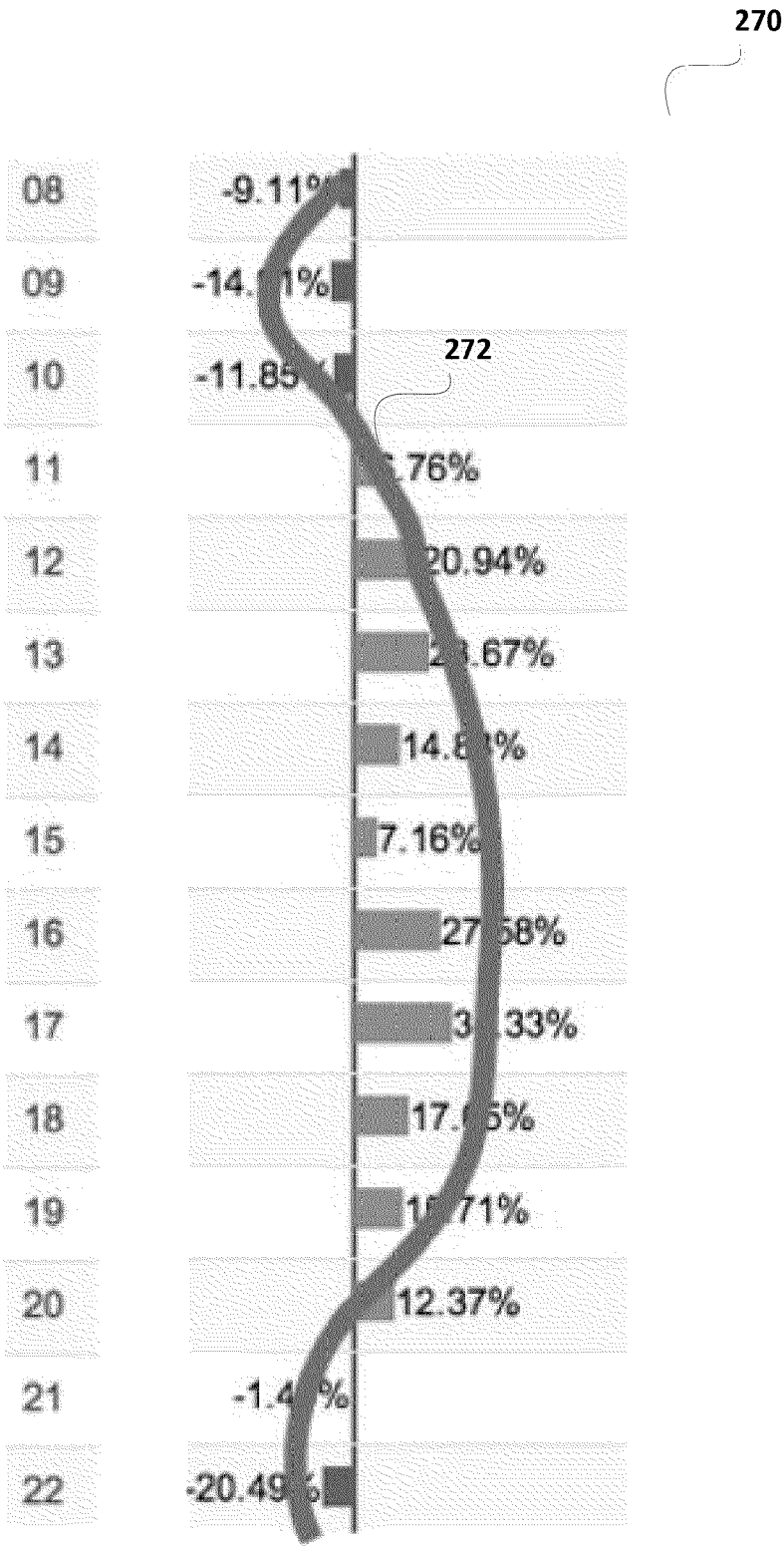
FIG. 2C illustrates a graph showing conversion volumes relative to an average conversion volume across different times of a day according to an illustrative implementation.

A similar approach can be taken for time of day based discrete states and type of device based discrete states. Referring briefly to FIG. 2C, a graph showing conversion volumes relative to an average conversion volume is depicted. The graph 270 includes, for each hour between 8 am and 10 pm, a conversion volume relative to an average conversion volume, referred to herein as a conversion volume deviation. The data points corresponding to the conversion volume relative to an average conversion volume at their respective hour for each hour between 8 am and 10 pm are plotted. For instance, at 8 am, the conversion volume deviation is −9.11%, at 11 am the conversion volume deviation is 6.76%, at 4 pm the conversion volume deviation is 27.68%, at 8 pm, the conversion volume deviation is 12.37% and at 10 pm, the conversion volume deviation is −20.49%. The data points appear to form a sinusoidal wave 272 when a line that passes through a plurality of points is formed. In some implementations, the bid efficiency improvement module can be configured to execute one or more scripts for identifying if any trends can be observed. For the sake of completeness, the conversion volumes between 11 pm and 8 pm were less than the predetermined thresholds and therefore not included in determining any trends. In some implementations, the bid efficiency improvement module can determine that the data is not sufficient to calculate one or more bid multipliers if the bid efficiency improvement module cannot identify any trends.

For example, in the example shown in FIG. 2C, if the conversion volume deviation varies from −10% at 3 pm to 10% at 4 pm to −8% at 5 pm and −2% at 6 pm and so on, the bid efficiency improvement module 125 may determine that no trend exists. In another example, if the data for which these conversion volume deviations are calculated is gathered over a long period of time, and the results show that every Tuesday between 10 am and 12 pm, the conversion volume deviation is at 20%, while at other times it fluctuates, the bid efficiency improvement module 125 can be determined to identify that there is a trend that has formed for the time between 10 am and 12 pm on Tuesdays. It is possible that such a trend is formed for keyword "fishing" and a television show on fishing is shown on Tuesdays between 10 am and 12 pm.

In some implementations, the bid efficiency improvement module 125 can also be configured to execute one or more tests for accuracy, for example, a test for skewness, such as those described in "Tests for Skewness, Kurtosis, and Normality for Time series Data" cited as Bai, Jushan, and Serena Ng. "Tests for skewness, kurtosis, and normality for time series data. "*Journal of Business & Economic Statistics*" 23.1 (2005): 49-60. In some implementations, the bid efficiency improvement module can be configured to identify if any of the data points is an outlier. In some implementations, the bid efficiency improvement module can employ an algorithm that utilizes the Grubb's test for outliers to disregard data points that are identified as being outliers.

As described above, the bid efficiency improvement module 125 can determine that there is insufficient data to calculate a bid multiplier for a given discrete state. In some such implementations, the bid efficiency improvement module 125, for example, can group all the discrete states of a particular type for which there is insufficient data to calculate a bid multiplier and assign them a single bid multiplier. The bid efficiency improvement module 125 can calculate the assigned bid multiplier to be a value such that the average bid across the plurality of discrete states for the particular type of discrete states averages to 1. This can be referred to as renormalizing the bid multipliers such that the overall multiplier effect is 1. This can be calculated by considering traffic volume, impression volume or click volume across the plurality of discrete states. In this way, by allowing the bid placement module 130 to automatically place bids using adjusted bid values, the costs incurred by the advertiser remain close, if not the same, as what the advertiser would have incurred without the automatic placement of bids.

For example, if the bid multiplier for Boston is 1.25, the bid multiplier for San Francisco is 0.9, and no other city in which the advertiser is willing to advertise has sufficient volume of data to determine a corresponding bid multiplier, the bid efficiency improvement module 125 is configured to calculate the bid multiplier for the remaining cities in which the advertiser is willing to advertise such that the overall multiplier effect is 1.0. Similarly, if the bid multiplier for mobile devices is 0.7 and the bid multiplier for desktop devices are 1.05, the bid multiplier for all other devices should be such that the overall bid multiplier effect is 1.0. This could mean that all other devices have a bid multiplier effect of 1.1. In some implementations, discrete states for which no bid multiplier can be determined can have a bid multiplier of 1.0, while the bid multipliers for discrete states that can be calculated can be normalized such that the overall multiplier effect is 1.0.

The bid efficiency improvement module 125 can further be configured to calculate one or more bid multipliers in response to identifying one or more statistically significant trends. The bid efficiency improvement module 125 can be configured to identify, from the advertising performance data, at least one performance metric for a plurality of discrete states. The bid efficiency improvement module 125 can be configured to determine that the performance metric for the plurality of discrete states is sufficient to calculate a bid multiplier for one or more of the discrete states. The bid efficiency improvement module 125 can be configured to compare a value associated with the performance metric of the discrete state relative to an average value associated with the performance metric for all of the corresponding discrete states.

The bid efficiency improvement module 125 is further designed, constructed or configured to calculate based on the advertising performance data for the identified keyword, bid multipliers for one or more of the discrete states. Each of the bid multipliers can be specific to a discrete state, which can be one of a geographic region in which the advertiser has elected to serve the ad, a time of day at which the ad is to be served, or a type of device on which the ad is to be served.

In some implementations, the bid efficiency improvement module 125 can calculate one or more bid multipliers for the identified keyword based on a geographic region in which the advertiser has elected to serve the at least one advertisement. The bid efficiency improvement module 125 can be configured to identify, from the advertising performance data, at least one performance metric for a plurality of geographic regions. The bid efficiency improvement module 125 can be configured to determine that the performance metric for the plurality of geographic regions is sufficient to calculate a bid multiplier for the geographic region. The bid efficiency improvement module 125 can be configured to compare the performance metric of the geographic region relative to the performance metric for the plurality of geographic regions. The bid efficiency improvement module 125 can be configured to determine a geographic region bid multiplier responsive to the comparison.

The bid efficiency improvement module 125 can calculate one or more bid multipliers based on a type of device on which the ad is to be served. The bid efficiency improvement module 125 can be configured to identify, from the advertising performance data, at least one performance metric for a plurality of device types. The bid efficiency improvement module 125 can be configured to determine that the performance metric for the plurality of device types is sufficient to calculate a bid multiplier for the type of device on which the ad is to be served. The bid efficiency improvement module 125 can be configured to compare the performance metric of the type of device on which the ad is to be served relative to the performance metric for the plurality of device types. The bid efficiency improvement module 125 can be configured to determine a type of device bid multiplier responsive to the comparison.

The bid efficiency improvement module 125 can be configured to store the calculated bid multipliers in a memory element of the data processing system. In some implementations, the bid efficiency improvement module 125 can be configured to store the calculated bid multipliers in a data store that is accessible by the bid placement module 130. The calculated bid multipliers can be stored with an identifier indicating the keyword with which the bid multiplier is associated. In addition, the calculated bid multipliers can be stored with an identifier indicating the advertiser with which the bid multiplier is associated.

In some implementations, the bid placement module can be configured to determine one or more parameters of an auction. In some implementations, the parameters of an auction can include the keyword or search query for which the auction is held, the geographic location of the user where winning ads will be served, the type of device on which the winning ads will be served, the time of day at which the winning ads will be served, amongst other information. The bid placement module 130 can determine the one or more parameters of the auction from an auction server. In some implementations, the ad server running the auction can provide the parameters to the bid placement module 130. In some implementations, the ad server is part of the data processing system 110. In some other implementations, the ad server that conducts the auctions is not a part of the data processing system 110 but is communicatively coupled to the data processing system 110.

In some implementations, each time the ad server runs an auction, the ad server sends the parameters of the auction to the data processing system. In some implementations, the bid placement module 130 is configured to retrieve one or more parameters of the auction from the ad server. In some implementations, the bid placement module 130 can be configured to determine a keyword associated with the auction. The bid placement module 130 in response to determining the keyword, can identify one or more advertisers having advertising accounts that would like to place a bid in the auction. In some implementations, the bid placement module can perform a lookup to identify advertisers that would like to place a bid in the auction.

In some implementations, the bid placement module 130 can perform a lookup to identify those advertisers that have enabled programmatic bid selection for that particular keyword. In some implementations, the bid placement module 130 can identify those advertisers that have enabled programmatic bid selection for that particular keyword by executing a script that identifies a list of advertisers that would like to bid on the particular keyword and further identifies from the list of advertisers, one or more advertisers that have also enabled programmatic bid selection for the keyword. In some implementations, such advertisers may have enabled programmatic bid selection for all keywords in a particular advertising account, ad campaign or ad group.

The bid placement module 130 can be configured to determine to place a bid in an auction for an advertiser that has opted to participate in programmatic bid selection. In some implementations, the bid placement module 130 can determine to calculate an appropriate composite bid multiplier based on the parameters of the auction. In some implementations, the bid placement module 130 can then identify a base bid value of the advertiser for the auction. In some implementations, the base bid value is provided by the advertiser and stored in a data store that includes information about the advertiser's advertising account. In some implementations, the bid placement module 130 can be configured to calculate the composite bid multiplier by identifying the parameters of the auction for which the bid efficiency improvement module 125 has calculated bid multipliers. Examples of the parameters include the time of day, the geographic region, and the type of device. As such, if an auction is held to place an ad on a user's mobile phone who is located in Boston, Mass. at 12:20 pm, the type of device parameter of the auction is a mobile phone, the geographic region parameter is Boston, Mass. and the time of day parameter is 12:20 pm.

In some implementations, the bid placement module 130 can be configured to determine the corresponding bid multipliers for one or more of the type of device parameter, the geographic region parameter and the time of day parameter. In some implementations, the bid placement module 130 can be configured to perform a lookup of the calculated bid multipliers that were stored in a data store by the bid efficiency improvement module 125. The bid placement module can identify the appropriate bid multipliers for one or more of the type of device parameter, the geographic region parameter and the time of day parameter. The bid placement module 130 can further be configured to combine the identified bid multipliers to compute a composite bid multiplier. In some implementations, the bid placement module 130 can further be configured to calculate the composite bid multiplier by multiplying each of the identified bid multipliers.

The bid placement module 130 can be designed, constructed or configured to determine or identify a base bid value of the advertiser for a keyword. The base bid value for the keyword can be provided by the advertiser to the data processing system 110. In some implementations, the base bid value for the keyword is stored in a data store and is associated with an advertising account of the advertiser. In some implementations, the bid placement module 130 can be configured to determine a base bid value by analyzing historical advertising auction data. In some implementations, the bid placement module 130 can retrieve advertising auction data for a particular keyword over a specific period of time. In some implementations, the bid placement module 130 can be configured to set the base bid value based on the retrieved advertising auction data. In some implementations, the bid placement module 130 can determine the base bid value based on industry averages or other empirical data publicly available.

In some implementations, the bid placement module 130 can calculate a bid value to place in an auction by multiplying the composite bid multiplier with the base bid value. The bid placement module 130 can be configured to pass the determined bid value to the ad server, which then places the determined bid value in the auction. In some implementations, the bid placement module 130 is configured to directly place the determined bid value in the auction.

In some implementations, the bid efficiency improvement module 125 can be configured to create and implement one or more bidding approaches to determine if the calculated bid multipliers are improving bid efficiency. The bid efficiency improvement module 125 can be configured to periodically retrieve advertising performance data associated with the advertiser's account for which the advertiser has enabled programmatic bid selection. The bid efficiency improvement module 125 can be configured to monitor the bid efficiency based on retrieving the advertising performance data. In some implementations, the bid efficiency improvement module 125 can be configured to analyze data retrieved or received from one or more advertisers to determine if the bid efficiency is improving. In some implementations, the bid efficiency improvement module 125 can be configured to analyze the revenues generated by the ads for the one or more advertisers. If the percentage increase in revenues generated by the ads for an advertiser is greater than the percentage increase in advertising costs, the bid efficiency improvement module determines that the bid efficiency has improved. Conversely, if the percentage increase in revenues generated by the ads for an advertiser is less than the percentage increase in advertising costs, the bid efficiency improvement module determines that the bid efficiency has gotten worse. In some implementations, the advertiser can analyze other metrics other than revenues to determine changes in bid efficiency. Examples of other metrics include cost per acquisition, relative costs per click, amongst others.

The bid efficiency improvement module 125 can also be configured to calculate one or more bid multipliers in response to receiving the advertising performance data. In some implementations, the bid efficiency improvement module 125 can be configured to switch off one or more of the bid multipliers for an A/B test to analyze the effects of the bid multipliers. In some implementations, the bid efficiency improvement module 125 can also run tests for other trends, for example, seasonality. In addition, the bid efficiency improvement module 125 can be configured to monitor other parameters that may not be included as part of the auction but may affect the volume of traffic for a particular keyword. For example, the bid efficiency improvement module 125 can be configured to determine if a news item has influenced a particular keyword. In this way, the bid efficiency improvement module 125 can be able to discount results that may be influenced by external events. In addition, the bid efficiency improvement module 125 can be configured to run tests to discount randomness. In addition, the bid efficiency improvement module 125 can be configured to identify outliers and discount or disregard the use of outlier data when determining changes in bid efficiency and when calculating bid multipliers.

Figure 3:
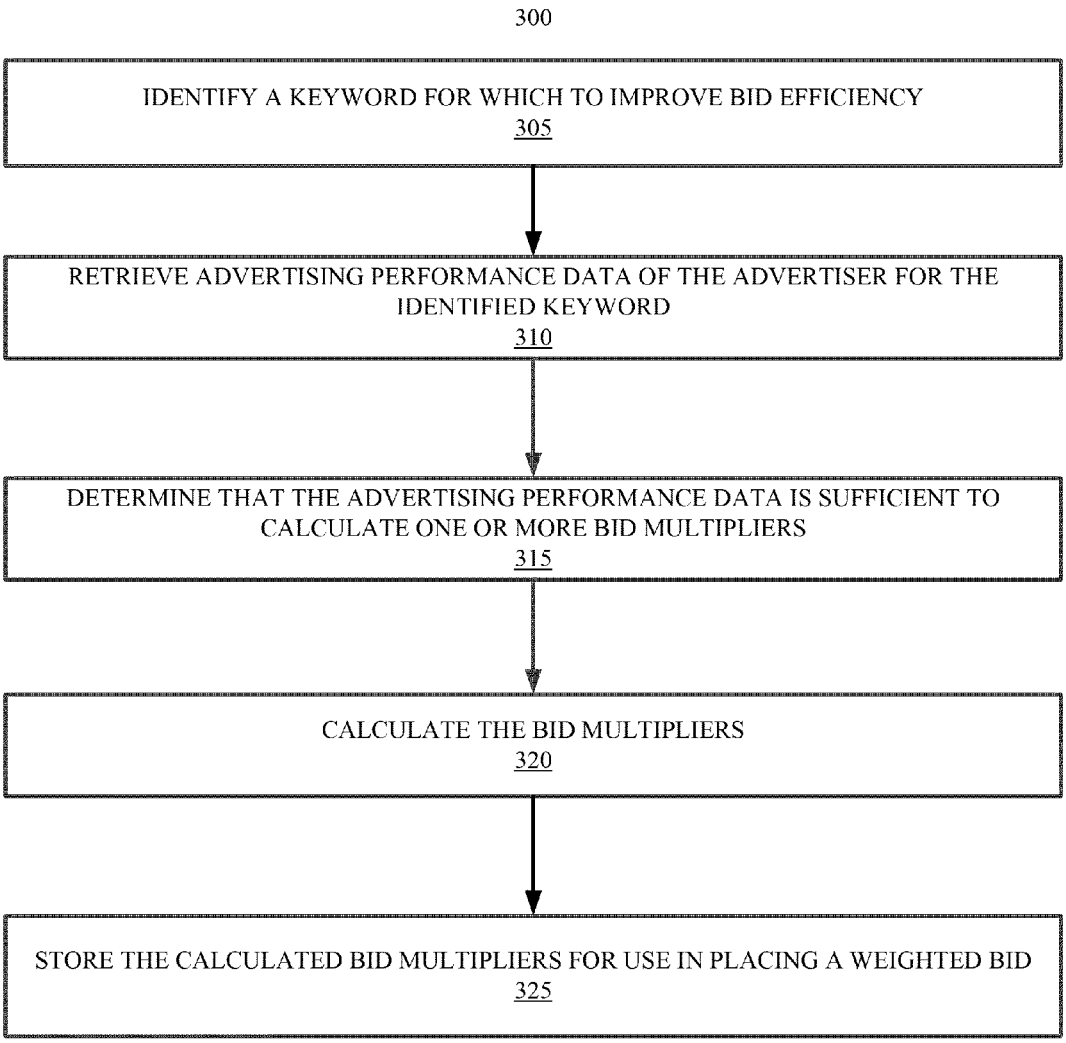
FIG. 3 is a flow diagram depicting one implementation of the steps taken to calculate one or more bid multipliers for improving the bidding efficiency of a third-party content provider.

FIG. 3 is a flow diagram depicting one implementation of the steps taken to one method for improving bid efficiency. In particular, FIG. 3 illustrates a flow diagram depicting a method 300 for calculating one or more bid multipliers using an advertiser's historical advertising performance data. In brief overview, a bid efficiency improvement module of a computing device identifies a keyword on which an advertiser has placed a bid to serve at least one ad (BLOCK 305). The bid efficiency improvement module then retrieves advertising performance data of the advertiser related to the identified keyword (BLOCK 310). The bid efficiency improvement module determines if the advertising performance data retrieved is sufficient to calculate one or more bid multipliers (BLOCK 315). The bid efficiency improvement module then calculates the bid multipliers (BLOCK 320). The bid efficiency improvement module then provides the calculated bid multipliers to place a weighted bid (BLOCK 325).

In further detail, a bid efficiency improvement module of a data processing system identifies a keyword on which an advertiser has placed a bid to serve at least one ad (BLOCK 305). The bid efficiency improvement module can identify the keyword from an advertising account of the advertiser. In some implementations, the bid efficiency improvement module may identify the keyword in response to determining that the advertiser has elected to participate in programmatic bid selection. In some implementations, the bid efficiency improvement module may determine this by determining if the advertiser has enabled programmatic bid selection. In some implementations, the bid efficiency improvement module can identify one or more keywords on which an advertiser has placed a bid to serve at least one ad and for which the advertiser has elected to participate in programmatic bid selection.

The bid efficiency improvement module is configured to retrieve advertising performance data of the advertiser related to the identified keyword (BLOCK 310). Examples of the advertiser's performance data can include the advertiser's bid prices, the average bidding price, impression volume, click volume, costs, impression rate, click through rate, conversion rate, cost per click, cost per action, average position rank, position rank amongst others. The advertising performance data can be retrieved from a database or table that logs the advertiser's bidding history as well as advertising performance. In some implementations, the advertising performance data can also include advertising performance data for a particular keyword. This may include information associated with the keyword and one or more auctions for the keyword. In some implementations, the advertising performance data for a particular keyword can include one or more statistics associated with bids placed on the keywords. Examples of statistics can include winning bid price, bidding volume, average winning bid price, average bidding volume, amongst others. The advertising performance data can also include other data that may be used by the bid efficiency improvement module to calculate bid multipliers. In some implementations, the table can be maintained in a storage device of the data processing system that is accessible by the bid efficiency improvement module. The advertising performance data can be retrieved for a particular time period. In some implementations, the time period can be a day, a week, a month or even longer. In some implementations, the time period for which advertising performance data is retrieved can be based in part on the amount of advertising performance data available within the time period.

In some implementations, the identified keyword can be a part of one or more advertising groups, one or more advertising campaigns or one or more advertising accounts of an advertiser. In some implementations, the bid efficiency improvement module can be configured to retrieve advertising performance data of the advertising group to which the identified keyword belongs. In some other implementations, the bid efficiency improvement module can be configured to retrieve advertising performance data of the advertising campaign to which the identified keyword belongs. In some implementations, the bid efficiency improvement module can be configured to retrieve advertising performance data of the advertising accounts of the advertiser to which the identified keyword belongs. In some other implementations, the bid efficiency improvement module can be configured to retrieve advertising performance data of a plurality of advertisers for the identified keyword. In some such implementations, the bid efficiency improvement module can retrieve advertising performance data of other advertisers that have elected to share their advertising performance data. In some implementations, the bid efficiency improvement module can be configured to retrieve other advertisers' advertising performance data by first identifying one or more advertisers that have previously placed bids on the identified keyword. In some implementations, this can be determined by analyzing advertising auction logs. In some implementations, the advertising auction logs can include auction related information associated with each keyword. In some implementations, the advertising auction logs can identify a winning advertiser, a winning bid amount, one or more parameters associated with the auction, including geographic region, time of day and type of device information, amongst others. By being able to retrieve and utilize advertising auction logs for the identified keyword including advertising performance data of other advertisers, the bid efficiency improvement module can be configured to calculate one or more bid multipliers using more data, thereby generating more accurate bid multipliers. Moreover, as described herein, by utilizing advertising performance data of multiple advertisers, the bid efficiency improvement module can avoid issues related to volume threshold by employing data aggregation.

The bid efficiency improvement module can determine if the advertising performance data retrieved is sufficient to calculate one or more bid multipliers (BLOCK 315). In some implementations, the bid efficiency improvement module can determine if the advertising performance data retrieved is sufficient based on the volume of data retrieved. In some implementations, the bid efficiency improvement module can run one or more statistical tests to determine if there is sufficient data to determine that one or more bid multipliers can be calculated.

In some implementations, the bid efficiency improvement module can determine if the advertising performance data retrieved is sufficient to calculate one or more time of day bid multipliers, geographic region bid multipliers or type of device bid multipliers. When determining if the advertising performance data retrieved is sufficient to calculate one or more time of day bid multipliers, the bid efficiency improvement module can first retrieve data corresponding to particular time periods. For example, the bid efficiency improvement module can retrieve one or more performance metrics, for example, conversion volume, impression volume, click through rate, click volume, amongst others, for one or more time periods over a time range. For example, the bid efficiency improvement module can retrieve the conversion volume over a time range of 1 week. The bid efficiency improvement module can retrieve the hourly conversion volume for each hour over the entire time range. The bid efficiency improvement module can then determine if the total conversion volume over the time range exceeds a predetermined volume threshold. If the total conversion volume over the time range does not exceed a predetermined volume threshold, the bid efficiency improvement module determines that the volume of data pertaining to the particular metric, that is the conversion volume, is not sufficient to generate a time of day bid multiplier. However, if the total conversion volume over the time range exceeds a predetermined volume threshold, the bid efficiency improvement module determines that the volume of data associated with the conversion volume is sufficient to calculate a time of day bid multiplier.

In some implementations, the bid efficiency improvement module can then determine, for each time period, for example, if the conversion volume for a particular time period exceeds a predetermined threshold volume for that particular time period. In some implementations, the time period can be a minute, an hour, a few hours, a day, or more than a day. In some implementations, the hourly predetermined volume threshold may be the same for each hour or may vary. If the hourly conversion volume for the particular hour does not exceed the predetermined volume threshold, the bid efficiency improvement module determines that the conversion volume for that particular time period is insufficient to calculate a bid multiplier for that particular time period. Conversely, if the hourly conversion volume for the particular hour does not exceed the predetermined volume threshold, the bid efficiency improvement module determines that the conversion volume for that particular time period is sufficient to calculate a bid multiplier for that particular time period.

The bid efficiency improvement module can determine if other performance metrics also have volume sufficient for calculating one or more bid multipliers. A similar process of determining if the total data volume exceeds a predetermined volume threshold is employed. In some implementations, the bid efficiency implementation module may also then determine if the data volume for each time period also exceeds a corresponding volume threshold for the time period.

The bid efficiency improvement module can similarly determine if one or more performance metrics also have volume sufficient for calculating one or more bid multipliers for geographic regions and types of devices. To determine if the performance metrics have sufficient volume to calculate geographic region bid multipliers, the bid efficiency improvement module can retrieve performance metric data based on one or more geographic regions. In some implementations, the geographic regions can be zip codes, cities, states, countries, or based on a metric such as income levels, average home prices, amongst others. Upon retrieving performance metric data based on one or more geographic regions, the bid efficiency improvement module can determine if the aggregate retrieved performance metric data for the geographic regions exceeds a predetermined threshold volume. The predetermined threshold volume can be based on the length of the time over which the aggregated retrieved performance metric data is retrieved. Upon determining that the aggregate retrieved performance metric data for the geographic regions exceeds a predetermined threshold volume, the bid efficiency improvement module can determine, using the performance metric data specific to a particular geographic region, if the volume of the performance data specific to the geographic region exceeds a predetermined volume threshold specific to the geographic region. If the volume of the performance data specific to the geographic region exceeds a predetermined volume threshold specific to the geographic region, the bid efficiency improvement module can determine that the performance metric data for that particular geographic region is sufficient to calculate one or more geographic region bid multipliers. Conversely, if the volume of the performance data specific to the geographic region does not exceed a predetermined volume threshold specific to the geographic region, the bid efficiency improvement module can determine that the performance metric data for that particular geographic region is not sufficient to calculate one or more geographic region bid multipliers.

To determine if the performance metrics have sufficient volume to calculate type of device bid multipliers, the bid efficiency improvement module can retrieve performance metric data based on one or more types of devices, for example, laptops, tablets, mobile phones amongst others. Upon retrieving performance metric data based on one or more types of devices, the bid efficiency improvement module can determine if the aggregate retrieved performance metric data for the type of device exceeds a predetermined threshold volume. The predetermined threshold volume can be based on the length of the time over which the aggregated retrieved performance metric data is retrieved. Upon determining that the aggregate retrieved performance metric data for the type of device exceeds a predetermined threshold volume, the bid efficiency improvement module can determine, using the performance metric data specific to a particular type of device, if the volume of the performance data specific to the type of device exceeds a predetermined volume threshold specific to the type of device. If the volume of the performance data specific to the type of device exceeds a predetermined volume threshold specific to the type of device, the bid efficiency improvement module can determine that the performance metric data for that particular geographic region is sufficient to calculate one or more geographic region bid multipliers. Conversely, if the volume of the performance data specific to the type of device does not exceed a predetermined volume threshold specific to the type of device, the bid efficiency improvement module can determine that the performance metric data for that particular geographic region is not sufficient to calculate one or more geographic region bid multipliers.

In some implementations, the bid efficiency improvement module can run additional tests, for example, a test for skewness. These tests can be run on the retrieved performance metric data used for calculating the one or more bid multipliers. The bid efficiency improvement module can run these additional tests to determine if the data is not biased, skewed, or misleading.

Once the bid efficiency improvement module determines that there is sufficient volume of data to calculate one or more bid multipliers corresponding to times of day, geographic regions, and device types, the bid efficiency improvement module calculates the one or more bid multipliers (BLOCK 320). The bid efficiency improvement module can calculate the bid multiplier based on the advertising performance metrics for which the bid efficiency improvement module determines that there is sufficient volume of data.

First, the bid efficiency improvement module can identify one or more discrete states for which to calculate bid multipliers. For example, a discrete state can be a time period, a geographic region or a type of device. The bid efficiency improvement module can identify the discrete states based on the determination that the performance metric data belonging to a particular discrete state exceeds a predetermined threshold volume, as described above with respect to BLOCK 315. Using a method of calculate one or more time of day bit multipliers as an example, the bid efficiency improvement module can identify one or more time periods for which the volume of the performance metric data exceeds a predetermined volume threshold. As described in the example shown in FIG. 2C, the one hour time periods between 8 am and 10 pm can be identified as discrete states for which to calculate bid multipliers.

Upon identifying the discrete states, the bid efficiency improvement module determines if the data corresponding to each of the discrete states forms a statistically significant trend. In some implementations, the bid efficiency improvement module can determine that the data corresponding to the discrete states is indicative of particular trends. For example, the data can indicate that the conversion rates in New York are higher than the conversion rates in Nebraska. The data may indicate that a cost per action is greater between the hours of 12 pm and 1 pm than between the hours of 8 pm and 9 pm. The data may indicate that a revenue per click is greater on a laptop than on a mobile device.

Based on the performance metrics relative to the discrete states, the bid efficiency improvement module can determine a bid multiplier for one or more of the discrete states. The bid multipliers can be based on a ratio of a value of a performance metric for a particular discrete state and the average value of the performance metric across all discrete states. In some implementations, the bid efficiency improvement module can be configured to calculate a bid multiplier input for each of the performance metrics that have been determined to have sufficient volume to calculate the bid multiplier. The bid efficiency improvement module can then combine one or more of the bid multiplier inputs to determine a bid multiplier for that particular discrete state.

In some implementations, the bid efficiency improvement module can be configured to determine if the calculated bid multiplier lies within an acceptable range. In some such implementations, the acceptable range can be defined based on industry standards, mathematical functions, amongst others. In some implementations, the acceptable range of the bid multiplier lies between 0.2 and 4.

The bid efficiency improvement module may store the calculated bid multipliers in a database that can be retrieved by a bid placement module (BLOCK 325). The bid efficiency improvement module may store the calculated bid multipliers in a table that also identifies the advertiser and the keyword on which the advertiser will bid using the calculated bid multipliers. A bid placement module of the data processing system can compute a composite bid multiplier to apply to a base bid that is based on one or more of the calculated bid multipliers. The bid placement module can compute the composite bid multiplier responsive to identifying parameters associated with an auction. In some implementations, the composite bid multiplier can be a combination of a time of day bid multiplier, a type of device bid multiplier, a geographic region bid multiplier, amongst others. For example, if the data processing system wishes to bid on a keyword for serving an ad to a user located in New York on the user's tablet at 2:15 pm, the bid placement module can retrieve a geographic region bid multiplier corresponding to New York, a type of device bid multiplier corresponding to a tablet and a time of day bid multiplier corresponding to 2:15 pm. The bid placement module can then multiply each of these bid multiplier inputs to form a composite bid for the particular auction. The bid placement module can then apply the composite bid multiplier to the base bid to determine a bid value. The bid placement module can then determine if the bid value lies within an acceptable range. In some implementations, the acceptable range of the composite bid multiplier lies between 0.2 and 4. Upon determining that the bid value lies within an acceptable range, the bid placement module passes the bid value to the ad server where the bid is placed.

The bid efficiency improvement module is further configured to analyze the results of the advertiser's performance with respect to the identified keyword over a period of time and to optimize the bid multipliers based on the analyzed results. The bid efficiency improvement module can be configured to retrieve new advertising performance data over a period of time during which the bid efficiency improvement module applies the bid multipliers. The bid efficiency improvement module extracts performance metrics from the new advertising performance data to determine if the bid efficiency has improved. The bid efficiency improvement module can determine that the bid efficiency has improved by determining, for example, that the cost per acquisition of a customer has decreased.

In some implementations, the bid efficiency improvement module can be configured to control the use of bid multipliers to test various theories. For example, in some implementations, the bid efficiency improvement module may be configured to turn off geographic region bid multipliers and device type bid multipliers to identify the effects of various time of day bid multipliers. In some implementations, the bid efficiency improvement module may be configured to test for seasonality.

As described herein, the systems and methods for improving bid efficiency is fully automated and is based on the user's own advertising performance data. Furthermore, the bid multipliers can periodically be updated as new advertising performance data is generated. In this way, the system and methods described herein can optimize automatically, reducing the costs advertisers currently spend on reporting and analysis.

Figure 4:
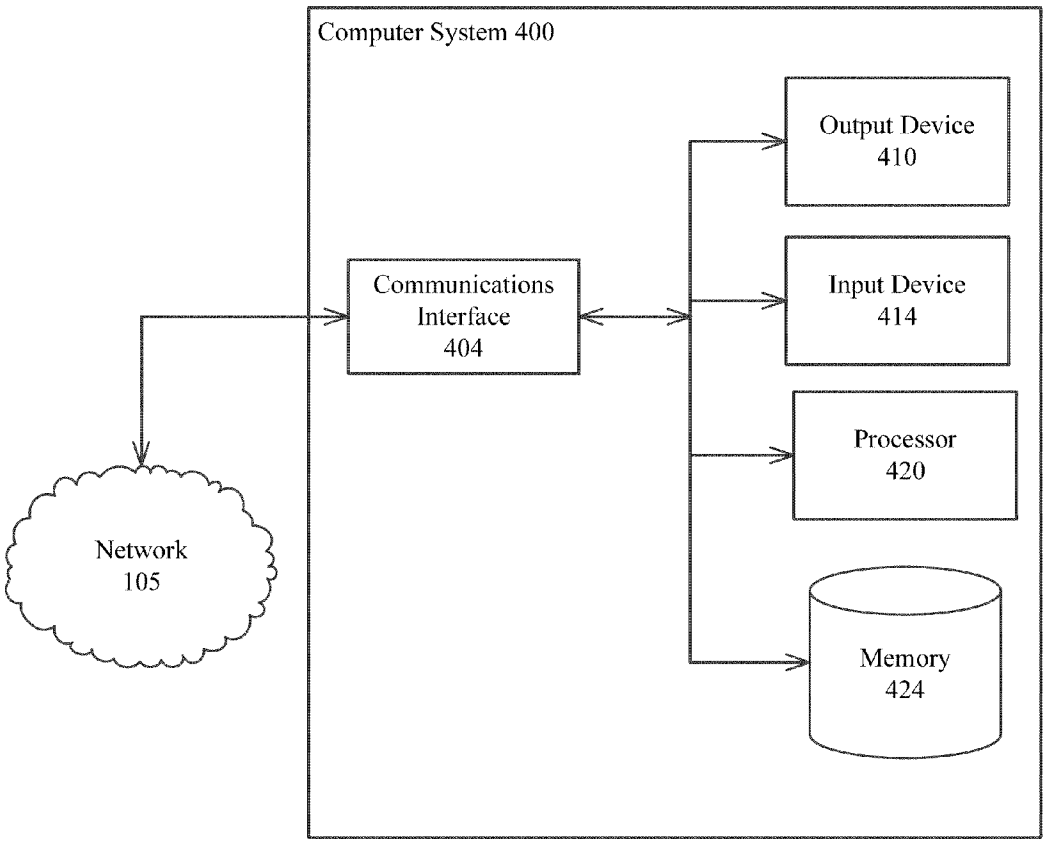
FIG. 4 is a block diagram illustrating an implementation of a general architecture for a computer system that may be employed to implement various elements of the systems and methods described and illustrated herein.

FIG. 4 shows the general architecture of an illustrative computer system 400 that may be employed to implement any of the computer systems discussed herein (including the system 100 and its components such as the bid efficiency improvement module 125 and the bid placement module 130) in accordance with some implementations. The computer system 400 can be used to provide information via the network 105 for display. The computer system 400 of FIG. 4 comprises one or more processors 420 communicatively coupled to memory 425, one or more communications interfaces 405, and one or more output devices 410 (e.g., one or more display units) and one or more input devices 415. The processors 420 can be included in the data processing system 110 or the other components of the system 100 such as the bid efficiency improvement module 125 and bid placement module 130.

In the computer system 400 of FIG. 4, the memory 425 may comprise any computer-readable storage media, and may store computer instructions such as processor-executable instructions for implementing the various functionalities described herein for respective systems, as well as any data relating thereto, generated thereby, or received via the communications interface(s) or input device(s) (if present). Referring again to the system 100 of FIG. 1, the bid efficiency improvement module 125 and bid placement module 130 can include the memory 425 to store information related to one or more advertisers, one or more ad auctions, advertising performance metric data associated with ads of the advertisers, including but not limited to impression volume, click volume, click through rates, conversion volumes, cost per acquisition data, revenues per conversion data, amongst others. The memory 425 can include the database 140. The processor(s) 420 shown in FIG. 4 may be used to execute instructions stored in the memory 425 and, in so doing, also may read from or write to the memory various information processed and or generated pursuant to execution of the instructions.

The processor 420 of the computer system 400 shown in FIG. 4 also may be communicatively coupled to or control the communications interface(s) 405 to transmit or receive various information pursuant to execution of instructions. For example, the communications interface(s) 405 may be coupled to a wired or wireless network, bus, or other communication means and may therefore allow the computer system 400 to transmit information to or receive information from other devices (e.g., other computer systems). While not shown explicitly in the system of FIG. 1, one or more communications interfaces facilitate information flow between the components of the system 100. In some implementations, the communications interface(s) may be configured (e.g., via various hardware components or software components) to provide a website as an access portal to at least some aspects of the computer system 400. Examples of communications interfaces 405 include user interfaces (e.g., web pages), through which the user can communicate with the data processing system 110.

The output devices 410 of the computer system 400 shown in FIG. 4 may be provided, for example, to allow various information to be viewed or otherwise perceived in connection with execution of the instructions. The input device(s) 415 may be provided, for example, to allow a user to make manual adjustments, make selections, enter data, or interact in any of a variety of manners with the processor during execution of the instructions. Additional information relating to a general computer system architecture that may be employed for various systems discussed herein is provided further herein.

Implementations of the subject matter and the operations described in this specification can be implemented in digital electronic circuitry, or in computer software embodied on a tangible medium, firmware, or hardware, including the structures disclosed in this specification and their structural equivalents, or in combinations of one or more of them. Implementations of the subject matter described in this specification can be implemented as one or more computer programs, i.e., one or more modules of computer program instructions, encoded on computer storage medium for execution by, or to control the operation of, data processing apparatus. The program instructions can be encoded on an artificially-generated propagated signal, e.g., a machine-generated electrical, optical, or electromagnetic signal that is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially-generated propagated signal. The computer storage medium can also be, or be included in, one or more separate physical components or media (e.g., multiple CDs, disks, or other storage devices).

The features disclosed herein may be implemented on a smart television module (or connected television module, hybrid television module, etc.), which may include a processing module configured to integrate internet connectivity with more traditional television programming sources (e.g., received via cable, satellite, over-the-air, or other signals). The smart television module may be physically incorporated into a television set or may include a separate device such as a set-top box, Blu-ray or other digital media player, game console, hotel television system, and other companion device. A smart television module may be configured to allow viewers to search and find videos, movies, photos and other content on the web, on a local cable TV channel, on a satellite TV channel, or stored on a local hard drive. A set-top box (STB) or set-top unit (STU) may include an information appliance device that may contain a tuner and connect to a television set and an external source of signal, turning the signal into content which is then displayed on the television screen or other display device. A smart television module may be configured to provide a home screen or top level screen including icons for a plurality of different applications, such as a web browser and a plurality of streaming media services, a connected cable or satellite media source, other web "channels", etc. The smart television module may further be configured to provide an electronic programming guide to the user. A companion application to the smart television module may be operable on a mobile computing device to provide additional information about available programs to a user, to allow the user to control the smart television module, etc. In alternate implementations, the features may be implemented on a laptop computer or other personal computer, a smartphone, other mobile phone, handheld computer, a tablet PC, or other computing device.

The operations described in this specification can be implemented as operations performed by a data processing apparatus on data stored on one or more computer-readable storage devices or received from other sources.

The terms "data processing apparatus", "data processing system", "user device" or "computing device" encompasses all kinds of apparatus, devices, and machines for processing data, including by way of example a programmable processor, a computer, a system on a chip, or multiple ones, or combinations, of the foregoing. The apparatus can include special purpose logic circuitry, e.g., an FPGA (field programmable gate array) or an ASIC (application-specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures. The bid efficiency improvement module 125, the bid placement module 130 can include or share one or more data processing apparatuses, computing devices, or processors.

A computer program (also known as a program, software, software application, script, or code) can be written in any form of programming language, including compiled or interpreted languages, declarative or procedural languages, and it can be deployed in any form, including as a stand-alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. The processes and logic flows can also be performed by, and apparatuses can also be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for performing actions in accordance with instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), for example. Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, implementations of the subject matter described in this specification can be implemented on a computer having a display device, e.g., a CRT (cathode ray tube), plasma, or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

Implementations of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components. The components of the system can be interconnected by any form or medium of digital data communication, e.g., a communication network. Examples of communication networks include a local area network ("LAN") and a wide area network ("WAN"), an inter-network (e.g., the Internet), and peer-to-peer networks (e.g., ad hoc peer-to-peer networks).

The computing system such as system 400 or system 100 can include clients and servers. For example, the data processing system 110 can include one or more servers in one or more data centers or server farms. A client and server are generally remote from each other and typically interact through a communication network. The relationship of client and server arises by virtue of computer programs running on the respective computers and having a client-server relationship to each other. In some implementations, a server transmits data (e.g., an HTML page) to a client device (e.g., for purposes of displaying data to and receiving user input from a user interacting with the client device). Data generated at the client device (e.g., a result of the user interaction) can be received from the client device at the server.

While this specification contains many specific implementation details, these should not be construed as limitations on the scope of any inventions or of what may be claimed, but rather as descriptions of features specific to particular implementations of the systems and methods described herein. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In some cases, the actions recited in the claims can be performed in a different order and still achieve desirable results. In addition, the processes depicted in the accompanying figures do not necessarily require the particular order shown, or sequential order, to achieve desirable results.

In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products. For example, the bid efficiency improvement module 125 and the bid placement module 130 can be part of the data processing system 110, a single module, a logic device having one or more processing modules, one or more servers, or part of a search engine.

Having now described some illustrative implementations and implementations, it is apparent that the foregoing is illustrative and not limiting, having been presented by way of example. In particular, although many of the examples presented herein involve specific combinations of method acts or system elements, those acts and those elements may be combined in other ways to accomplish the same objectives. Acts, elements and features discussed only in connection with one implementation are not intended to be excluded from a similar role in other implementations or implementations.

The phraseology and terminology used herein is for the purpose of description and should not be regarded as limiting. The use of "including" "comprising" "having" "containing" "involving" "characterized by" "characterized in that" and variations thereof herein, is meant to encompass the items listed thereafter, equivalents thereof, and additional items, as well as alternate implementations consisting of the items listed thereafter exclusively. In one implementation, the systems and methods described herein consist of one, each combination of more than one, or all of the described elements, acts, or components.

Any references to implementations or elements or acts of the systems and methods herein referred to in the singular may also embrace implementations including a plurality of these elements, and any references in plural to any implementation or element or act herein may also embrace implementations including only a single element. References in the singular or plural form are not intended to limit the presently disclosed systems or methods, their components, acts, or elements to single or plural configurations. References to any act or element being based on any information, act or element may include implementations where the act or element is based at least in part on any information, act, or element.

Any implementation disclosed herein may be combined with any other implementation, and references to "an implementation," "some implementations," "an alternate implementation," "various implementation," "one implementation" or the like are not necessarily mutually exclusive and are intended to indicate that a particular feature, structure, or characteristic described in connection with the implementation may be included in at least one implementation. Such terms as used herein are not necessarily all referring to the same implementation. Any implementation may be combined with any other implementation, inclusively or exclusively, in any manner consistent with the aspects and implementations disclosed herein.

References to "or" may be construed as inclusive so that any terms described using "or" may indicate any of a single, more than one, and all of the described terms.

Where technical features in the drawings, detailed description or any claim are followed by reference signs, the reference signs have been included for the sole purpose of increasing the intelligibility of the drawings, detailed description, and claims. Accordingly, neither the reference signs nor their absence have any limiting effect on the scope of any claim elements.

The systems and methods described herein may be embodied in other specific forms without departing from the characteristics thereof. Although the examples provided herein relate to an advertising program, the systems and methods described herein can be applied to any program in any vertical in which bidding efficiency can be improved. The foregoing implementations are illustrative rather than limiting of the described systems and methods. Scope of the systems and methods described herein is thus indicated by the appended claims, rather than the foregoing description, and changes that come within the meaning and range of equivalency of the claims are embraced therein.

What is claimed is:

1. A method for improving a third-party content provider's bid efficiency in an auction, comprising:

identifying, by a bid efficiency improvement module of a data processing system, a keyword on which a third-party content provider has placed a bid to serve at least one ad;

retrieving by the bid efficiency improvement module, for the identified keyword, third-party content performance data associated with the identified keyword;

determining by the bid efficiency improvement module, for the identified keyword, that the third-party content performance data is sufficient to calculate one or more bid multipliers;

calculating by the bid efficiency improvement module, based on the third-party content performance data for the identified keyword, the one or more bid multipliers, each of the bid multipliers corresponding to at least one parameter having a plurality of discrete states; and storing the calculated bid multipliers in a memory element of the data processing system.

2. The method of claim 1, wherein the third-party content performance data includes one or more of a number of clicks, impressions, cost, average ad position, conversions, click through rate, and conversion rate.

3. The method of claim 1, wherein determining, for each of the identified keywords, that the third-party content performance data is sufficient to calculate one or more bid multipliers includes determining, for each of the identified keywords, that the third-party content performance data exceeds a threshold volume of data.

4. The method of claim 3, wherein the third-party content performance data includes a total number of conversions within a given time period and the threshold volume of data includes a predetermined number of conversions corresponding to the given time period.

5. The method of claim 1, further comprising placing a weighted bid responsive to calculating the bid multipliers, the weighted bid being a product of the one or more calculated bid multipliers and a base bid value.

6. The method of claim 5, wherein placing a weighted bid responsive to calculating the bid multipliers includes determining that the weighted bid lies within an acceptable range.

7. The method of claim 1, further comprising:

serving a plurality of third-party content items responsive to placing a plurality of weighted bids;

retrieving new third-party content performance data responsive to serving the plurality of third-party content items; and determining that the weighted bids improve bid efficiency responsive to comparing the new third-party content performance data with the retrieved third-party content performance data retrieved prior to serving the plurality of third-party content items.

8. The method of claim 1, wherein each of the bid multipliers is based on one of a geographic region in which the third-party content item is to be served, a time of day at which the third-party content item is to be served, or a type of device on which the third-party content item is to be served.

9. The method of claim 8, wherein calculating one or more bid multipliers based on a geographic region in which the third-party content item is to be served includes:

identifying, from the third-party content performance data, at least one performance metric for the third-party content item across a plurality of geographic regions;

determining that the identified performance metric for the third-party content item is sufficient to calculate a bid multiplier for the geographic region in which the third-party content item is to be served;

comparing the performance metric of the geographic region in which the third-party content item is to be served relative to the performance metric for the third-party content item across the plurality of geographic regions; and determining a geographic region bid multiplier corresponding to the geographic region in which the third-party content item is to be served responsive to the comparison.

10. The method of claim 8, wherein calculating one or more bid multipliers based on a time of day at which the third-party content item is to be served includes:

identifying, from the third-party content performance data, at least one performance metric for the third-party content item across a plurality of time periods;

determining that the performance metric for the third-party content item is sufficient to calculate a bid multiplier for the time of day at which the third-party content item is to be served;

comparing the performance metric of the time of day at which the third-party content item is to be served relative to the performance metric for the third-party content item across the plurality of time periods; and determining a time of day bid multiplier for the time of day at which the third-party content item is to be served responsive to the comparison.

11. The method of claim 8, wherein calculating one or more bid multipliers based on a type of device on which the third-party content item is to be served includes:

identifying, from the third-party content performance data, at least one performance metric for the third-party content item across a plurality of device types;

determining that the performance metric for the third-party content item is sufficient to calculate a bid multiplier for the type of device on which the third-party content item is to be served;

comparing the performance metric of the type of device on which the third-party content item is to be served relative to the performance metric for the plurality of device types; and determining a type of device bid multiplier for the type of device on which the third-party content item is to be served responsive to the comparison.

12. A system for improving an third-party content provider's bid efficiency in an auction, comprising:

a data processing system including a bid efficiency improvement module, the data processing system further including a memory storing processor-executable instructions; and a processor configured to:

identify a keyword on which a third-party content provider has placed a bid to serve at least one third-party content item;

retrieve for the identified keyword, third-party content performance data associated with the identified keyword;

determine, for the identified keyword, that the third-party content performance data is sufficient to calculate one or more bid multipliers;

calculate, based on the third-party content performance data for the identified keyword, the one or more bid multipliers, each of the bid multipliers corresponding to at least one parameter having a plurality of discrete states; and store the calculated bid multipliers in a memory element of the data processing system.

13. The system of claim 12, wherein the third-party content performance data includes one or more of a number of clicks, impressions, cost, average ad position, conversions, click through rate, and conversion rate.

14. The system of claim 12, wherein in determining, for each of the identified keywords, that the third-party content performance data is sufficient to calculate one or more bid multipliers, the processor is further configured to determine, for each of the identified keywords, that the third-party content performance data exceeds a threshold volume of data.

15. The system of claim 12, wherein the third-party content performance data includes a total number of conversions within a given time period and the threshold volume of data includes a predetermined number of conversions corresponding to the given time period.

16. The system of claim 12, wherein the processor is further configured to place a weighted bid responsive to calculating the bid multipliers.

17. The system of claim 16, wherein in placing a weighted bid responsive to calculating the bid multipliers, the processor is further configured to determine that the weighted bid lies within an acceptable range.

18. The system of claim 12, wherein the processor is further configured to:

serve a plurality of third-party content items responsive to placing a plurality of weighted bids;

retrieve new third-party content performance data responsive to serving the plurality of third-party content items; and determine that the weighted bids improve bid efficiency responsive to comparing the new third-party content performance data with the retrieved third-party content performance data retrieved prior to serving the plurality of third-party content items.

19. The system of claim 12, wherein each of the bid multipliers is based on one of a geographic region in which the third-party content provider has elected to serve the third-party content item, a time of day at which the third-party content item is to be served, or a type of device on which the third-party content item is to be served.

20. The system of claim 19, wherein to calculate one or more bid multipliers based on a geographic region in which the third-party content provider has elected to serve the at least one third-party content item, the processor is further configured to:

identify, from the third-party content performance data, at least one performance metric for the third-party content item across a plurality of geographic regions;

determine that the identified performance metric for the third-party content item is sufficient to calculate a bid multiplier for the geographic region in which the third-party content item is to be served;

compare the performance metric of the geographic region in which the third-party content item is to be served relative to the performance metric for the third-party content item across the plurality of geographic regions; and determine a geographic region bid multiplier corresponding to the geographic region in which the third-party content item is to be served responsive to the comparison.

21. The system of claim 19, wherein to calculate one or more bid multipliers based on a time of day at which the third-party content item is to be served, the processor is further configured to:

identify, from the third-party content performance data, at least one performance metric for the third-party content item across a plurality of time periods;

determine that the performance metric for the third-party content item is sufficient to calculate a bid multiplier for the time of day at which the third-party content item is to be served;

compare the performance metric of the time of day at which the third-party content item is to be served relative to the performance metric for the third-party content item across the plurality of time periods; and determine a time of day bid multiplier for the time of day at which the third-party content item is to be served responsive to the comparison.

22. The system of claim 19, wherein to calculate one or more bid multipliers based on a type of device on which the third-party content item is to be served, the processor is further configured to:

identify, from the third-party content performance data, at least one performance metric for the third-party content item across a plurality of device types;

determine that the performance metric for the third-party content item is sufficient to calculate a bid multiplier for the type of device on which the third-party content item is to be served;

compare the performance metric of the type of device on which the third-party content item is to be served relative to the performance metric for the plurality of device types; and determine a type of device bid multiplier for the type of device on which the third-party content item is to be served responsive to the comparison.

* * * * *